US010352165B2

(12) United States Patent
Kodama et al.

(10) Patent No.: US 10,352,165 B2
(45) **Date of Patent: *Jul. 16, 2019**

(54) MINE MINING SYSTEM

(71) Applicants: Komatsu Ltd., Tokyo (JP); The University of Tokyo, Tokyo (JP)

(72) Inventors: Yuichi Kodama, Hiratsuka (JP); Masaaki Uetake, Kawasaki (JP); Kazunari Kawai, Kawasaki (JP); Shinichi Terada, Kawasaki (JP); Rui Fukui, Tokyo (JP)

(73) Assignees: Komatsu Ltd., Tokyo (JP); The University of Tokyo, Tokyo (JP)

( * ) Notice: Subject to any disclaimer, the term of this patent is extended or adjusted under 35 U.S.C. 154(b) by 163 days.

This patent is subject to a terminal disclaimer.

(21) Appl. No.: 15/025,356

(22) PCT Filed: Sep. 30, 2014

(86) PCT No.: PCT/JP2014/076192

§ 371 (c)(1),
(2) Date: Mar. 28, 2016

(87) PCT Pub. No.: WO2015/046601

PCT Pub. Date: Apr. 2, 2015

(65) Prior Publication Data

US 2016/0215621 A1 Jul. 28, 2016

(30) Foreign Application Priority Data

Sep. 30, 2013 (JP) ..... 2013-205975

(51) Int. Cl.
*E21C 35/20* (2006.01)
*E21C 41/22* (2006.01)
(Continued)

(52) U.S. Cl.
CPC ..... *E21C 41/16* (2013.01); *E21C 35/20* (2013.01); *E21C 41/22* (2013.01); *E21F 13/00* (2013.01);
(Continued)

(58) Field of Classification Search
CPC ..... E21C 41/16; E21C 41/22; E21C 35/20; E21C 41/14; E21F 13/025; E21F 13/06; E21F 13/063
See application file for complete search history.

(56) References Cited

U.S. PATENT DOCUMENTS 2,298,599 A * 10/1942 Smith ..... E21C 41/16 299/18
4,465,155 A * 8/1984 Collins ..... B62D 1/28 180/169
(Continued)

OTHER PUBLICATIONS

International Search Report dated Jan. 20, 2015, issued for PCT/JP2014/076192.

*Primary Examiner* — Janine M Kreck
*Assistant Examiner* — Michael A Goodwin
(74) *Attorney, Agent, or Firm* — Locke Lord LLP

(57) ABSTRACT

A mine mining system mining ore from a vein in a mine including a mining area provided inside an ore body, a first mine shaft provided inside the ore body, and a second mine shaft connecting the mining area and the first mine shaft to each other, the mine mining system includes: a transporting machine which loads the ore mined in the mining area and transports the ore to a soil discharge area while traveling in the first mine shaft; and a loading machine which stays in the second mine shaft, excavates the ore in the mining area, conveys the excavated ore in a direction moving away from the mining area, and loads the ore on the transporting machine.

10 Claims, 15 Drawing Sheets

(51) Int. Cl.

| | |
|---|---|
| ***E21F 13/02*** | (2006.01) |
| ***E21F 13/06*** | (2006.01) |
| ***E21C 41/16*** | (2006.01) |
| ***E21F 13/00*** | (2006.01) |

(52) U.S. Cl.
CPC ..... *E21F 13/025* (2013.01); *E21F 13/063* (2013.01); *E21F 13/065* (2013.01)

(56) References Cited

U.S. PATENT DOCUMENTS

| | | | | |
|---|---|---|---|---|
| 4,512,610 | A | 4/1985 | Gilbert et al. | |
| 5,293,947 | A * | 3/1994 | Stratton | B60K 6/46 180/2.1 |
| 7,899,599 | B2 | 3/2011 | Makela et al. | |
| 8,955,657 | B2 * | 2/2015 | Osara | H02J 7/345 191/3 |
| 2003/0205421 | A1 * | 11/2003 | Allen | B60L 3/0046 180/65.1 |
| 2006/0273756 | A1 * | 12/2006 | Bowling | H02J 7/0004 320/107 |
| 2007/0046094 | A1 | 3/2007 | Gross et al. | |
| 2007/0170771 | A1 | 7/2007 | Cavinder et al. | |
| 2013/0048382 | A1 * | 2/2013 | Rudinec | E21B 7/025 175/57 |
| 2013/0106165 | A1 * | 5/2013 | Oddie | E21C 41/22 299/13 |
| 2014/0286738 | A1 * | 9/2014 | Zimmerman | E21F 13/002 414/328 |

* cited by examiner

MINE MINING SYSTEM

CROSS REFERENCE TO RELATED APPLICATIONS

This application is related to two co-pending applications: "MINE MANAGEMENT SYSTEM" filed even date herewith in the names of Yuichi KODAMA; Masaaki UETAKE; Kazunari KAWAI; Shinichi TERADA and Rui FUKUI as a national phase entry of PCT/JP2014/076190 filed Sep. 30, 2014; and "MINE MANAGEMENT SYSTEM" filed even date herewith in the name of Yuichi KODAMA; Masaaki UETAKE; Kazunari KAWAI; Shinichi TERADA and Rui FUKUI as a national phase entry of PCT/JP2014/076207 filed Sep. 30, 2014, which applications are assigned to the assignee of the present application and all three incorporated by reference herein.

FIELD

The present invention relates to a mine mining system used for an underground mining work.

BACKGROUND

As a mining method used in a mine, there are known an opencast mining method of mining ore from a ground surface and an underground mining method of mining ore from an underground place. Since an environmental burden needs to be reduced and an ore existing part is located at a deep position, the underground mining method has been more frequently used in recent years. For example, according to a working machine disclosed in Patent Literature 1, a vehicle excavating ore by a bucket enters a mine shaft so as to excavate the ore and moves in the mine shaft while holding the excavated ore by the bucket.

CITATION LIST

Patent Literature

Patent Literature 1: U.S. Pat. No. 7,899,599

SUMMARY

Technical Problem

Generally, there is a demand to improve the productivity in the mine. The same also applies to the underground mining work. In the technique disclosed in Patent Literature 1, since the vehicle excavating the ore transports the ore while holding the ore, the productivity cannot be sufficiently improved.

An object of the invention is to improve the productivity of an underground mining work.

Solution to Problem

According to the present invention, a mine mining system mining ore from a vein in a mine including a mining area provided inside an ore body, a first mine shaft provided inside the ore body, and a second mine shaft connecting the mining area and the first mine shaft to each other, the mine mining system comprises: a transporting machine which loads the ore mined in the mining area and transports the ore to a soil discharge area while traveling in the first mine shaft; and a loading machine which stays in the second mine shaft, excavates the ore in the mining area, conveys the excavated ore in a direction moving away from the mining area, and loads the ore on the transporting machine.

In the present invention, it is preferable that the mine includes a plurality of the first mine shafts and a third mine shaft connected to the first mine shafts and a circuit is formed by the third mine shaft and the first mine shafts.

In the present invention, it is preferable that an one-way passage is allowed in the first mine shaft.

In the present invention, it is preferable that the transporting machine travels in the circuit in one direction.

In the present invention, it is preferable that the circuit includes two first mine shafts and two third mine shafts, and the two first mine shafts have different traveling directions.

In the present invention, it is preferable that the mine includes a plurality of the soil discharge areas.

In the present invention, it is preferable that the transporting machine includes a traveling motor and a storage battery supplying power to the motor.

In the present invention, it is preferable that a storage battery treatment device replacing or charging the storage battery mounted on the transporting machine is provided in a space connected to the third mine shafts.

In the present invention, it is preferable that the loading machine performs at least one of the ore excavating operation and a traveling operation by at least one of power supplied from an outside of the loading machine and power supplied from a storage battery mounted on the loading machine.

In the present invention, it is preferable that the first mine shafts or the second mine shaft is provided with a power supply device supplying power to the loading machine.

According to the present invention, a mine mining system mining ore from a vein in a mine including a mining area provided inside an ore body, a first mine shaft provided inside the ore body, and a second mine shaft connecting the mining area and the first mine shaft to each other, the mine mining system comprises: a transporting machine which loads the ore mined in the mining area and transports the ore to a soil discharge area while traveling in the first mine shaft; and a loading machine which stays in the second mine shaft while a space used for the transporting machine to travel therein is left inside the first mine shaft, excavates the ore in the mining area, conveys the excavated ore in a direction moving away from the mining area, and loads the ore on the transporting machine, wherein the transporting machine travels in a circuit formed by two first mine shafts of a plurality of the first mine shafts and two third mine shafts connected to the first mine shafts in one direction and each third mine shaft is provided with the soil discharge area.

Advantageous Effects of Invention

According to the invention, it is possible to improve the productivity of an underground mining work.

DESCRIPTION OF EMBODIMENTS

A mode for carrying out the invention (an embodiment) will be described in detail with reference to the drawings. Hereinafter, a positional relation among components will be described on the assumption that one direction within a predetermined plane is the X-axis direction, a direction orthogonal to the X-axis direction within a predetermined plane is the Y-axis direction, and a direction orthogonal to the X-axis direction and the Y-axis direction is the Z-axis direction. Further, the gravity action direction is set as the downside and the opposite direction to the gravity action direction is set as the upside. The productivity of the mine includes both the mining amount per unit time (t/h) and the cost per unit time ($/h). In the productivity of the mine, both quotients can be used as indexes as illustrated in the equation (1). $/t of the equation (1) is an index indicating productivity, t is a mining amount, h is time, and $ is cost. As the index $/t illustrated in the equation (1) decreases, the productivity of the mine increases.

$$\$/t=(\$/h)/(t/h) \quad (1)$$

<Outline of Mining Site>

Figure 1:
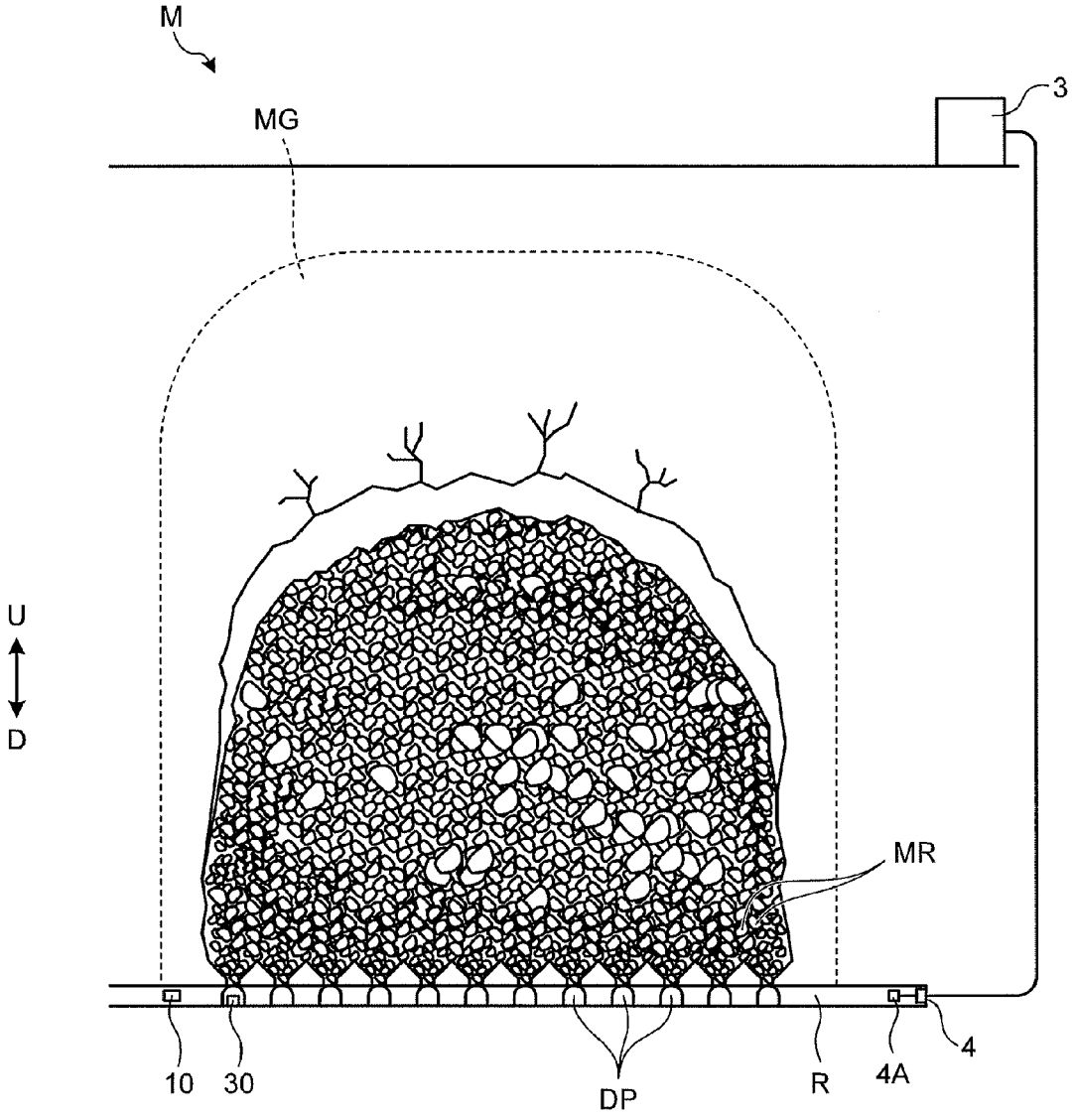
FIG. 1 is a schematic diagram illustrating an example of a site in which a transporting machine and a loading machine according to an embodiment are operated.

FIG. 1 is a schematic diagram illustrating an example of a site in which a transporting machine 10 and a loading machine 30 according to the embodiment are operated. The transporting machine 10 and the loading machine 30 are used for an underground mining method of mining ore from an underground place. The transporting machine 10 is a kind of a working machine which transports a load in a mine shaft R, and the loading machine 30 is a kind of a working machine which loads a load on the transporting machine 10. In the embodiment, ore is mined according to a block caving method.

The block caving method indicates a method in which an ore body (a vein) MG of a mine M is provided with a mining area (hereinafter, appropriately referred to as a draw point) DP for the ore MR and the mine shaft R for conveying mined ore and the upside of the draw point DP is undercut and blasted so as to naturally break and drop the ore MR. Accordingly, the ore MR is mined from the draw point DP. The draw point DP is provided at the inside of the ore body MG or the downside D of the ore body MG. The block caving method is a method that uses a principle in which a weak rock collapses when the downside of the rock bed or the ore body is undercut. When the ore MR is mined from the downside or the inside of the ore body MG, the upper part is broken. For this reason, when the block caving method is used, the ore MR of the ore body MG can be efficiently mined. In the block caving method, the draw point DP is generally provided at a plurality of positions.

In the embodiment, a management device 3 is disposed on a ground. The management device 3 is provided in a management facility on a ground. In principle, the movement of the management device 3 is not considered. The management device 3 manages a mining site. The management device 3 can communicate with working machines including the transporting machine 10 and the loading machine 30 and used in the underground mine via a communication system including a radio communication device 4 and an antenna 4A. In the embodiment, the transporting machine 10 and the loading machine 30 are unmanned working machines, but may be manned working machines which are operated by an operator.

<Underground Mine MI>

Figure 2:
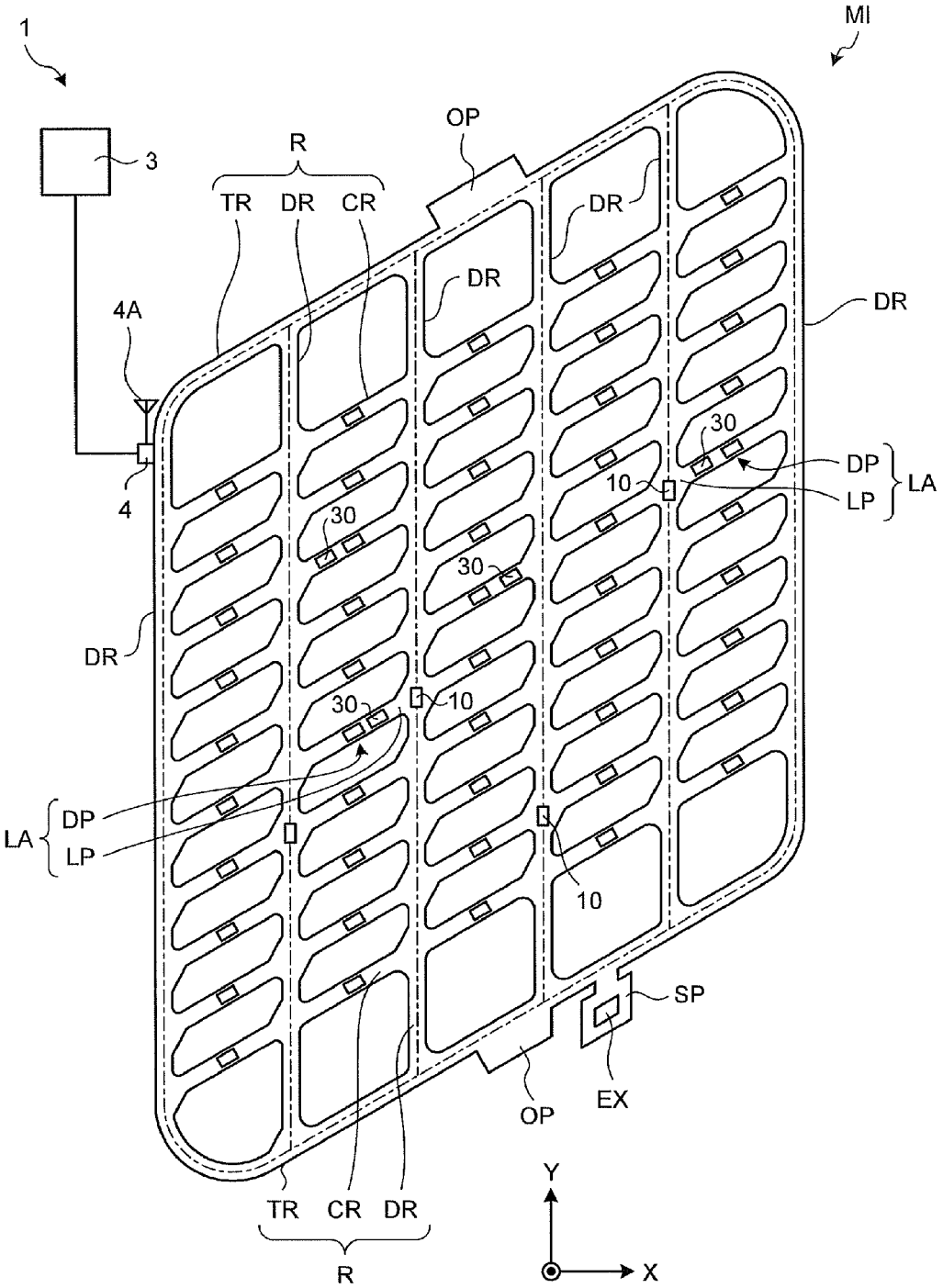
FIG. 2 is a schematic diagram illustrating an example of an underground mine and a mine mining system.
Figure 3:
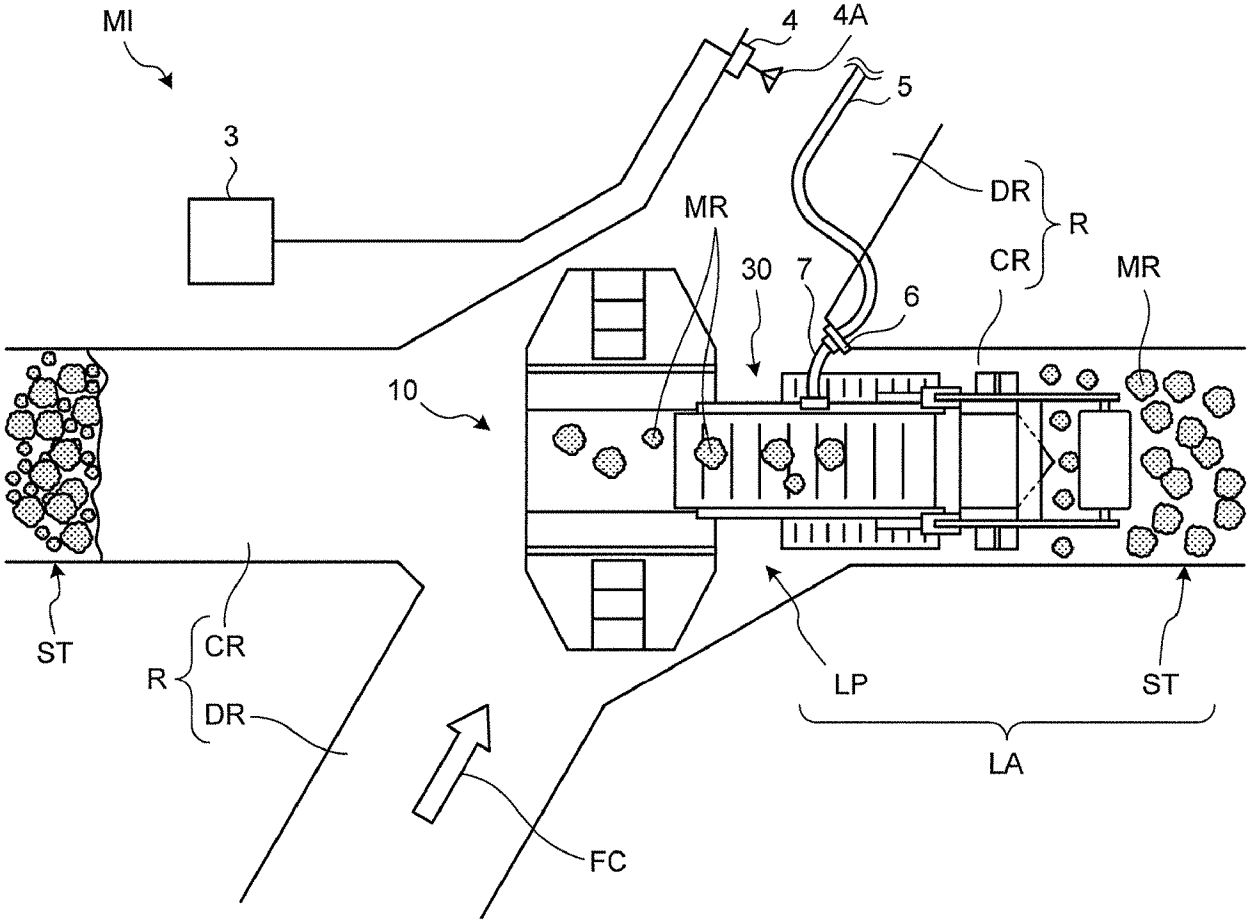
FIG. 3 is a partially enlarged diagram of FIG. 2.

FIG. 2 is a schematic diagram illustrating an example of the underground mine MI and the mine mining system. FIG. 3 is a partially enlarged diagram of FIG. 2. As illustrated in these drawings, the mine shaft R provided in the ore body MG includes the first mine shaft DR and the second mine shaft CR. The mine shaft R is provided at, for example, the downside D of the ore body MG or the inside of the ore body MG. In the embodiment, each of the first mine shaft DR and the second mine shaft CR exists at a plurality of positions in the underground mine MI. The second mine shaft CR connects each draw point DP and each first mine shaft DR to each other. The loading machine 30 can approach the draw point DP through the second mine shaft CR. In the embodiment, the mine shaft R includes a third mine shaft TR. In the embodiment, a plurality of (in this example, two) third mine shafts TR is connected to the first mine shafts DR. Hereinafter, the first mine shaft DR will be appropriately referred to as the drift DR, the second mine shaft CR will be appropriately referred to as the cross cut CR, and the third mine shaft TR will be appropriately referred to as the outer track TR.

As illustrated in FIG. 2, the underground mine MI is provided with two outer tracks TR. Each outer track TR is not divided by the draw point DP unlike the cross cut CR. One outer track TR connects one ends of the drifts DR, and one outer track TR connects the other ends of the drifts DR. Likewise, all drifts DR are connected to two outer tracks TR. In the embodiment, the transporting machine 10 and the loading machine 30 can enter any drift DR from the outer track TR. In the example illustrated in FIG. 3, the transporting machine 10 and the loading machine 30 travel inside the drift DR in a direction indicated by the arrow FC.

As illustrated in FIGS. 2 and 3, a loading position LP where the loading machine 30 loads a load on the transporting machine 10 is set at the cross cut CR or the vicinity thereof. An area including the draw point DP and the loading position LP is referred to as a loading area LA.

As illustrated in FIG. 2, the underground mine MI is provided with a soil discharge area (an ore pass) OP in which the ore MR as the load transported by the transporting machine 10 is discharged. The transporting machine 10 loads the ore MR as the load thereon by the loading machine 30 in the loading area LA near the draw point DP, travels in the drift DR, and moves to the ore pass OP. The transporting machine 10 discharges the ore MR as the load to the arrived ore pass OP.

In the embodiment, the transporting machine 10 illustrated in FIGS. 2 and 3 includes a traveling motor and a storage battery supplying power to the motor. A space SP is connected to the outer track TR. The space SP connected to the outer track TR is provided with a storage battery treatment device EX which replaces the storage battery mounted on the transporting machine 10.

In the description below, for convenience of the description, it is assumed that the XY plane is substantially parallel to the road surface of the mine shaft R in which the transporting machine 10 travels. In fact, the road surface of the mine shaft R is uneven or is inclined upward and downward in many cases.

The mine mining system 1 illustrated in FIG. 2 includes the management device 3 and the radio communication antenna 4A. The management device 3 manages, for example, the operation of the transporting machine 10 and the loading machine 30 operated in the underground mine MI. The operation management includes the allocation of the transporting machine 10 and the loading machine 30 and the collection and the management of the information (hereinafter, appropriately referred to as operation information) on the operation state of the transporting machine 10 and the loading machine 30. The operation information includes, for example, the operation time of the transporting machine 10 and the loading machine 30, the traveling distance thereof, a remaining storage battery amount, an abnormality check, an abnormality position, and a loading amount. The operation information is mainly used for the operation evaluation, the preventive maintenance, and the abnormality diagnosis of the transporting machine 10 and the loading machine 30. Thus, the operation information is useful in that the productivity of the mine M is improved or the operation of the mine is improved.

The management device 3 includes a communication device as will be described later. The radio communication device 4 including the antenna 4A is connected to the communication device. The management device 3 exchanges information with the transporting machine 10 and the loading machine 30 operated in the underground mine MI via, for example, the communication device, the radio communication device 4, and the antenna 4A. As described above, the management device 3 of the mine mining system 1 manages the operation of the transporting machine 10 and the loading machine 30. For this reason, the mine mining system 1 will be appropriately referred to as the mine operation management system 1 herebelow.

In the embodiment, the loading machine 30 travels by a traveling motor and excavates the ore MR while driving a raking device by a motor. As illustrated in FIG. 3, a power feeding cable 5 which supplies power from the outside of the loading machine 30 to the motors is provided in the mine shaft R of the underground mine MI. The loading machine 30 receives power from the power feeding cable 5 through, for example, a power feeding connector 6 provided in the loading area LA so as to serve as a power supply device and a power cable 7 extending from the loading machine 30. The power supply device may be provided in the drift DR or the cross cut CR. In the embodiment, the loading machine 30 may perform at least one of the traveling operation and the excavating operation by the external power. Further, the loading machine 30 may be equipped with a storage battery so as to perform at least one of the traveling operation and the excavating operation by the power supplied from the storage battery. Further, the loading machine 30 may be equipped with a storage battery so as to perform at least one of the traveling operation and the excavating operation by the power supplied from the storage battery. That is, the loading machine 30 performs at least one of the traveling operation and the excavating operation by at least one of the external power and the power supplied from the storage battery. For example, the loading machine 30 may perform the excavating operation by the external power and perform the traveling operation by the power supplied from the storage battery. Further, the loading machine 30 may perform the traveling operation by the external power when traveling inside the cross cut CR. In the embodiment, the loading machine 30 may excavate the ore MR by driving a hydraulic pump by a motor so as to generate a hydraulic pressure and driving the hydraulic motor by the hydraulic pressure. Further, the loading machine 30 may perform the excavating operation while traveling by the power supplied from the storage battery mounted therein.

The connection between the power feeding cable 5 and the power cable 7 extending from the loading machine 30 is not limited to the connector 6. For example, power may be supplied from the power feeding cable 5 to the loading machine 30 in a manner such that an electrode provided near the mine shaft R and connected to the power feeding cable 5 and an electrode connected to the power cable 7 extending from the loading machine 30 are used as a power supply device and both electrodes contact each other. In this way, even when the positioning precision of both electrodes is low, power can be supplied to the loading machine 30 while both electrodes contact each other. In the embodiment, the loading machine 30 is operated electrically, but the invention is not limited thereto. The loading machine 30 may travel or excavate the ore MR by, for example, an internal combustion engine. In this case, the loading machine 30 may travel or excavate the ore MR in a manner such that a hydraulic pump is driven by the internal combustion engine and, for example, a hydraulic motor or a hydraulic cylinder is driven by hydraulic oil ejected from the hydraulic pump.

<Excavation and Transportation of Ores MR>

Figure 4:
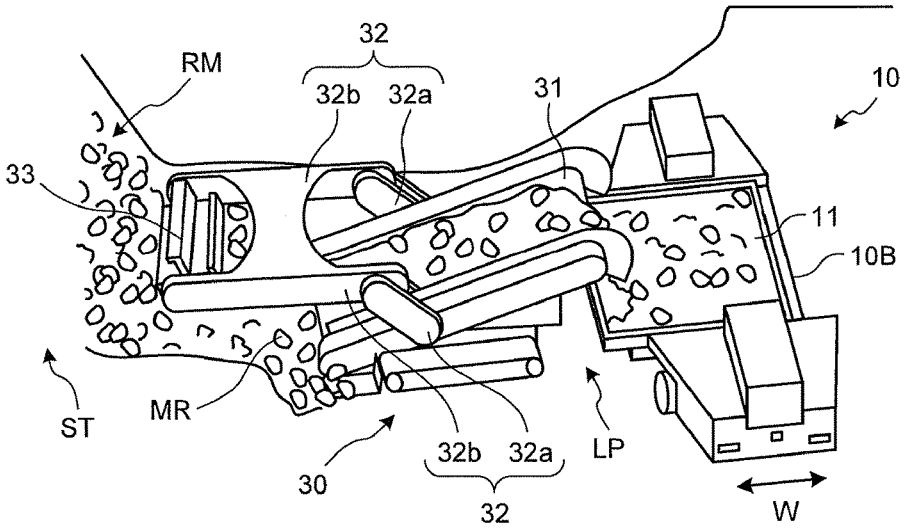
FIG. 4 is a diagram illustrating a state where ore of a rock mass are excavated by a loading machine so as to be loaded on a transporting machine.
Figure 5:
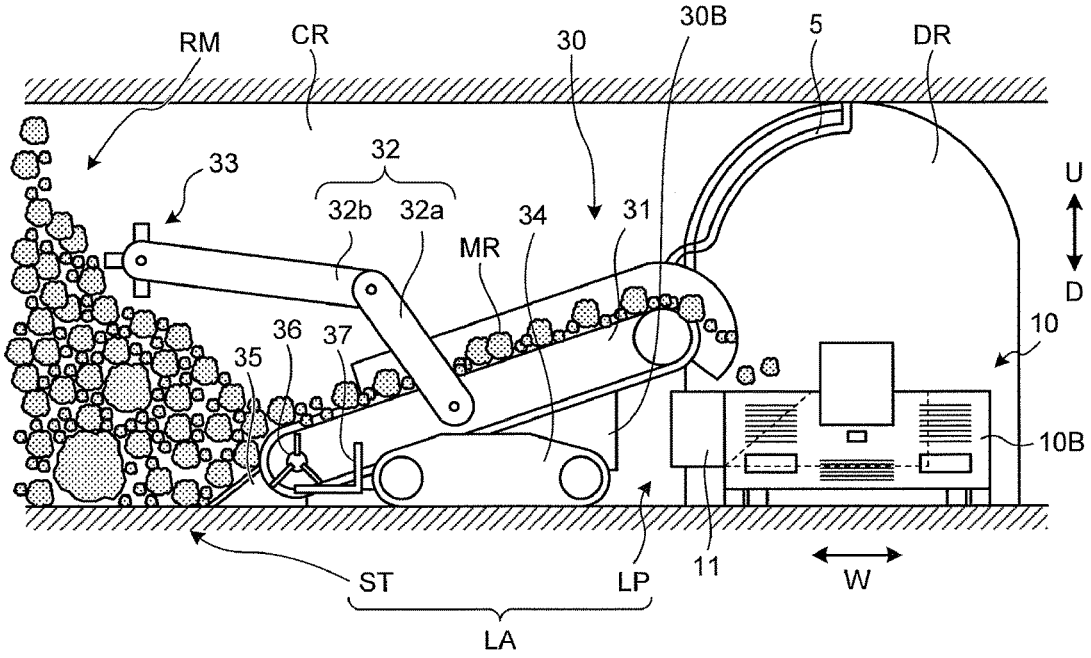
FIG. 5 is a diagram illustrating a state where ore of a rock mass are excavated by a loading machine so as to be loaded on a transporting machine.

FIGS. 4 and 5 are diagrams illustrating a state where the ore MR of the rock mass RM are excavated by the loading machine 30 so that the ore MR are loaded on the transporting machine 10. In the loading area LA, the rock mass RM of the ore MR is formed at the draw point DP. As illustrated in FIGS. 4 and 5, the loading machine 30 is provided inside the cross cut CR of the loading area LA and performs the excavating operation while the front end thereof penetrates the rock mass RM of the ore MR. The loading machine 30 loads the excavated ore MR onto the transporting machine 10 which is located at the opposite side to the rock mass RM so as to be located inside the drift DR in a standby state. The power feeding cable 5 which supplies power to the loading machine 30 is provided inside the drift DR.

As illustrated in FIGS. 4 and 5, the loading machine 30 includes a vehicle body 30B, a feeder 31 serving as a conveying device, a rotation roller 33 serving as an excavating device, a support mechanism 32 supporting the rotation roller 33, and a traveling device 34. The rotation roller 33 and the support mechanism 32 serve as a raking device that excavates the ore MR and feeds the ore to the feeder 31.

The support mechanism 32 includes a boom 32*a* which serves as a first member attached to the vehicle body 30B and an arm 32*b* which swings while being connected thereto and serves as a second member and rotatably supports the rotation roller 33. The vehicle body 30B of the loading machine 30 includes a penetration member 35 that penetrates the rock mass RM of the ore MR, a rotation body 36, and a rock guard 37. The penetration member 35 penetrates the rock mass RM when excavating the ore MR. The rotation body 36 assists the penetration while rotating when the penetration member 35 of the loading machine 30 penetrates the rock mass RM.

The transporting machine 10 includes a vehicle body 10B and a vessel 11. The vessel 11 is mounted on the vehicle body 10B. The vessel 11 loads the ore MR as a load thereon. In the embodiment, the vessel 11 moves in the width direction W of the vehicle body 10B, that is, a direction parallel to the axle as illustrated in FIGS. 4 and 5. The vessel 11 is provided at the center of the vehicle body 10B in the width direction when the transporting machine 10 travels. Further, the vessel 11 moves outward in the width direction of the vehicle body 10B when the ore MR is loaded thereon. As a result, since the transporting machine 10 can move the vessel 11 toward the downside D of the feeder 31 of the loading machine 30, it is possible to reliably drop the ore MR into the vessel 11 by decreasing the possibility that the ore MR conveyed by the feeder 31 falls to the outside of the vessel 11.

In the embodiment, as illustrated in FIGS. 4 and 5, the loading machine 30 excavates the ore MR and conveys the excavated ore MR so that the ore is loaded on the transporting machine 10. The transporting machine 10 conveys the ore MR loaded thereon to the ore pass OP illustrated in FIG. 2 and discharges the ore thereto. At this time, the loading machine 30 stays in the cross cut CR while the traveling space of the transporting machine 10 is left inside the drift DR, and the ore MR is excavated at the draw point DP. Then, the loading machine 30 conveys the excavated ore MR in a direction moving away from the draw point DP and loads the ore onto the transporting machine 10. The loading machine 30 does not move while the excavated ore MR is loaded thereon. The transporting machine 10 loads the ore MR mined at the draw point DP and travels in the drift DR so as to transport the ore to the ore pass OP illustrated in FIG. 2.

Likewise, in the embodiment, the mine mining system 1 causes the loading machine 30 to perform only an operation of excavating and loading the ore MR and causes the transporting machine 10 to perform only an operation of transporting the ore MR. In this way, both functions are separated. For this reason, the loading machine 30 can be used only for the excavating work and the conveying work and the transporting machine 10 can be used only for the transporting work. That is, the loading machine 30 may not have a function of transporting the ore MR and the transporting machine 10 may not have a function of excavating and conveying the ore MR. Since the loading machine 30 can be dedicated for the function of excavating and conveying the ore and the transporting machine 10 can be dedicated for the function of transporting the ore MR, the functions can be exhibited maximally. As a result, the mine management system 1 can improve the productivity of the mine M.

<Management Device 3 of Mine Mining System 1 or Mine Operation Management System 1>

Figure 6:
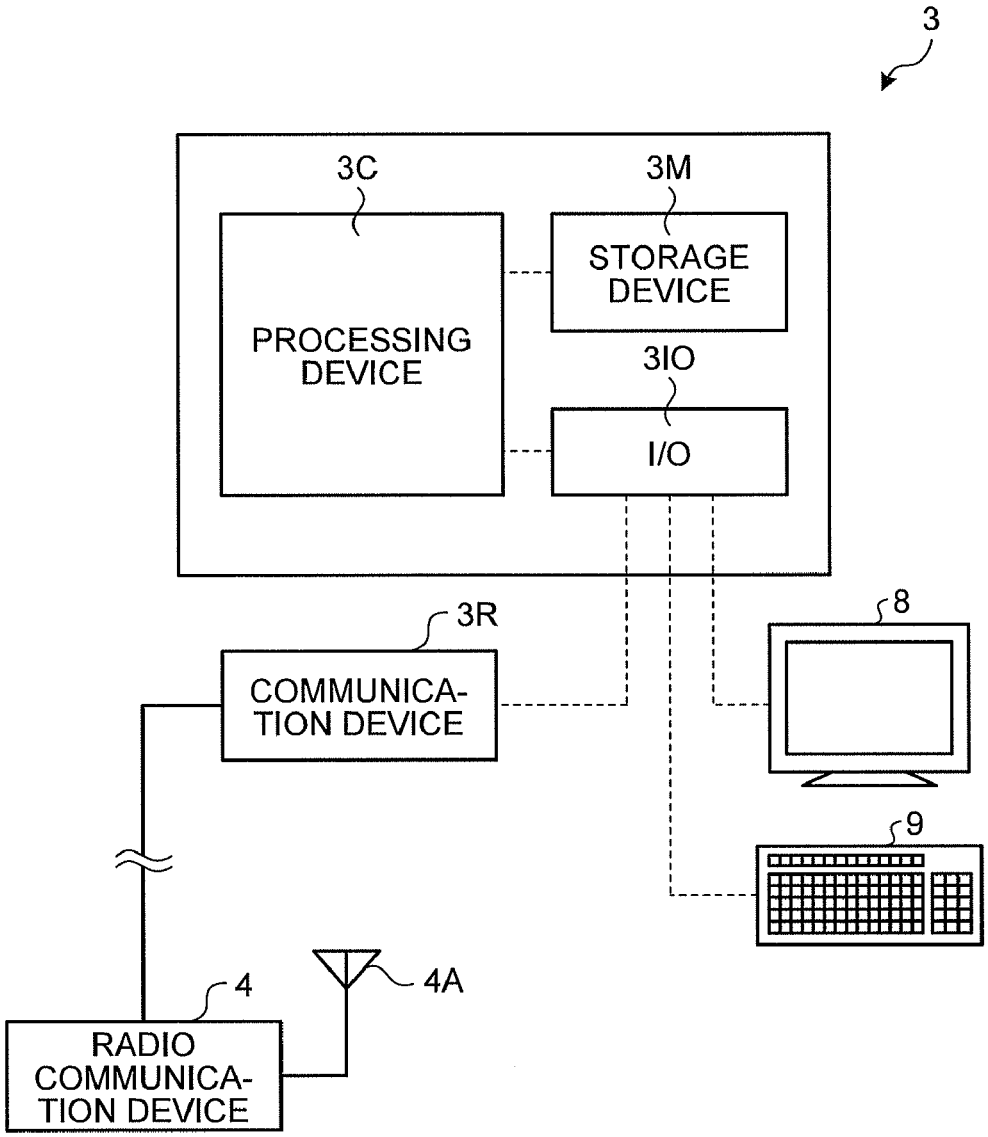
FIG. 6 is an example of a functional block diagram of a management device of a mine mining system or a mine operation management system.

FIG. 6 is an example of a functional block diagram of the management device 3 of the mine mining system 1 or the mine operation management system 1. The management device 3 includes a processing device 3C, a storage device 3M, and an input and output unit (I/O) 310. Further, the management device 3 has a configuration in which a display device 8 as an output device, an input device 9, and a communication device 3R are connected to the input and output unit 310. The management device 3 is, for example, a computer. The processing device 3C is, for example, a CPU (Central Processing Unit). The storage device 3M is, for example, a RAM (Random Access Memory), a ROM (Read Only Memory), a flash memory, or a hard disk drive or a combination thereof. The input and output unit 310 is used as an input and output unit (an interface) that inputs and outputs information to and from the processing device 3C, the display device 8 connected to the outside of the processing device 3C, the input device 9, and the communication device 3R.

The processing device 3C performs a process of the management device 3 involved with the allocation of the transporting machine 10 and the loading machine 30 and the collection of the operation information. The process involved with the allocation and the collection of the operation information is realized in a manner such that the processing device 3C reads out a corresponding computer program from the storage device 3M and executes the corresponding computer program.

The storage device 3M stores various computer programs for performing various processes by the processing device 3C. In the embodiment, the computer program stored in the storage device 3M corresponds to, for example, a computer program for allocating the transporting machine 10 and the loading machine 30, a computer program for collecting the operation information of the transporting machine 10 and the loading machine 30, and a computer program used for various kinds of analysis based on the operation information.

The display device 8 is, for example, a liquid crystal display and displays information necessary for the allocation of the transporting machine 10 and the loading machine 30 or the collection of the operation information. The input device 9 is, for example, a keyboard, a touch panel, or a mouse and is used to input information necessary when the transporting machine 10 and the loading machine 30 are allocated or the operation information is collected. The communication device 3R is connected to the radio communication device 4 including the antenna 4A. As described above, the radio communication device 4 and the antenna 4A are provided in the underground mine MI. The communication device 3R and the radio communication device 4 are connected to each other by a wire. The communication device 3R can communicate with the transporting machine 10 and the loading machine 30 of the underground mine MI by, for example, a wireless LAN (Local Aria Network). Next, the transporting machine 10 will be described in more detail.

<Transporting Machine 10>

Figure 7:
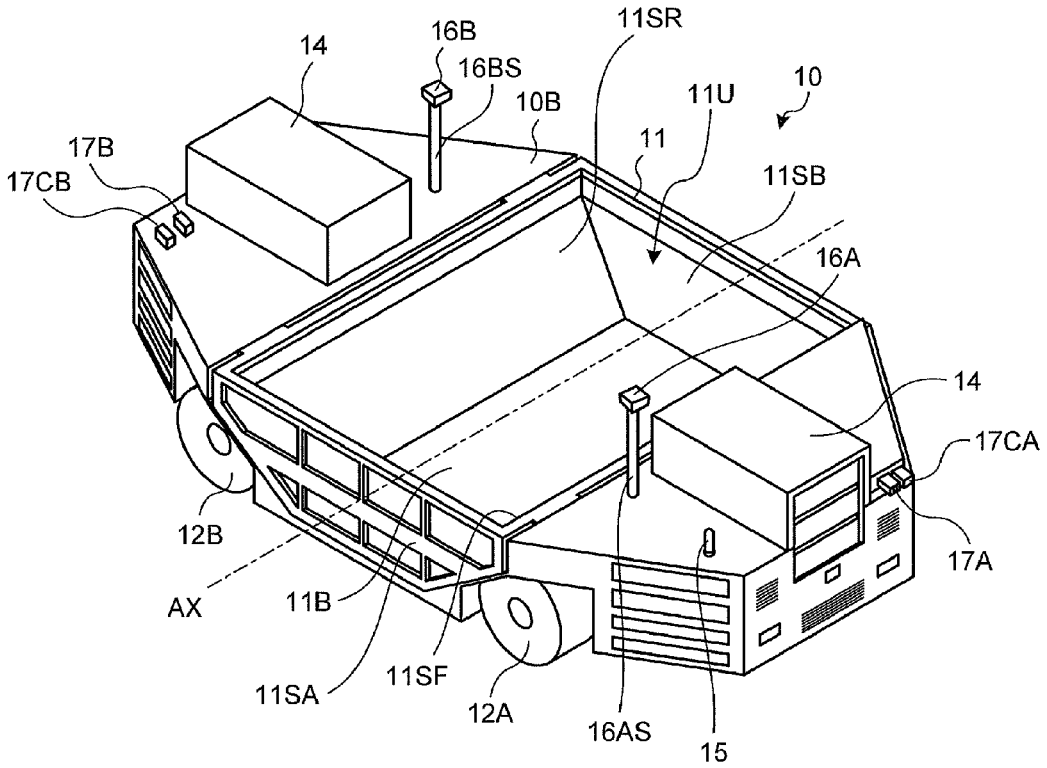
FIG. 7 is a perspective view of a transporting machine according to the embodiment.
Figure 8:
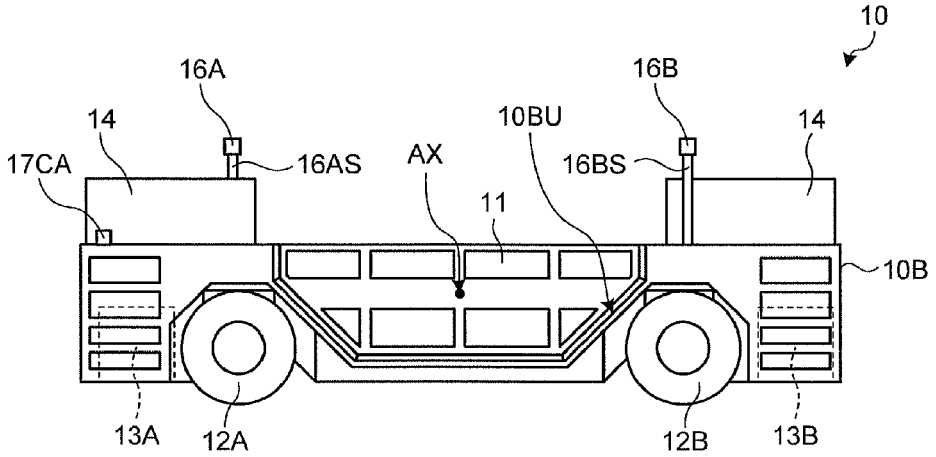
FIG. 8 is a side view of the transporting machine according to the embodiment.

FIG. 7 is a perspective view of the transporting machine 10 according to the embodiment. FIG. 8 is a side view of the transporting machine 10 according to the embodiment. The transporting machine 10 includes the vehicle body 10B, the vessel 11, and vehicle wheels 12A and 12B. Further, the transporting machine 10 includes a storage battery 14 as a condenser, an antenna 15, image capturing devices 16A and 16B, and non-contact sensors 17A and 17B. The vehicle wheels 12A and 12B are respectively provided at the front and rear sides of the vehicle body 10B. In the embodiment, the vehicle wheels 12A and 12B are driven by motors 13A and 13B mounted inside the vehicle body 10B illustrated in FIG. 8. Likewise, the transporting machine 10 has a configuration in which all vehicle wheels 12A and 12B serve as drive wheels. Further, in the embodiment, the vehicle wheels 12A and 12B are respectively steering wheels. In the embodiment, the vehicle wheels 12A and 12B are, for example, solid tires. With such a configuration, since the vehicle wheels 12A and 12B have small diameters, the height of the transporting machine 10 is suppressed. The transporting machine 10 can travel in any one of a direction from the vehicle wheel 12A to the vehicle wheel 12B and a direction from the vehicle wheel 12B to the vehicle wheel 12A. The vehicle wheels 12A and 12B may not be solid tires and may be, for example, pneumatic tires or the like. Further, only one of the vehicle wheels 12A and 12B may be the drive wheel.

The vessel 11 is mounted at the upside of the vehicle body 10B and is supported by the vehicle body 10B. The vehicle body 10B is equipped with the storage battery 14 which supplies power to the motors 13A and 13B. In the embodiment, the outer shape of the storage battery 14 is a rectangular parallelopiped shape. The storage battery 14 is mounted on each of the front and rear sides of the vehicle body 10B. With such a configuration, since the mass of the transporting machine 10 is substantially uniform in the front and rear direction, the transporting machine can travel stably. The storage battery 14 is mounted on the vehicle body 10B in an attachable and detachable manner. By the power supplied from the storage battery 14, the motors 13A and 13B and the electronic devices of the transporting machine 10 are operated. In the embodiment, the transporting machine 10 is operated electrically, but an internal combustion engine may be a power source.

The vehicle body 10B is equipped with the antenna 15, the image capturing devices 16A and 16B, and the non-contact sensors 17A and 17B. The antenna 15 communicates with the management device 3 according to a radio communication via the antenna 4A and the communication device 3R illustrated in FIG. 6. The image capturing devices 16A and 16B capture the image of the load loaded on the vessel 11. In the embodiment, the state (the packing style) of the ore MR illustrated in FIGS. 3 and 4 is captured as an image. The image capturing devices 16A and 16B may be, for example, cameras using visible rays or IR cameras using infrared rays. The image capturing devices 16A and 16B are respectively attached to front ends of support pillars 16AS and 16BS attached to the upper surface of the vehicle body 10B. With such a structure, since the image capturing devices 16A and 16B can capture the image of the entire vessel 11 from the upside, the state of the ore MR loaded on the vessel 11 can be reliably captured as an image.

The non-contact sensors 17A and 17B are respectively attached to the front and rear sides of the vehicle body 10B. The non-contact sensors 17A and 17B detect an object existing in the periphery of the transporting machine 10, that is, an object existing in the advancing direction in a non-contact state. As the non-contact sensors 17A and 17B, for example, radar devices are used. The non-contact sensors 17A and 17B can detect the distance and the orientation with respect to the object by emitting radio waves or ultrasonic waves and receiving radio waves reflected from the object. The non-contact sensors 17A and 17B are not limited to the radar devices. Each of the non-contact sensors 17A and 17B may include at least one of, for example, a laser scanner and a three-dimensional distance sensor.

The transporting machine 10 includes periphery monitoring cameras 17CA and 17CB which are respectively provided at the front and rear sides of the vehicle body 10B so as to serve as the image capturing devices. The periphery monitoring cameras 17CA and 17CB detect the object existing in the periphery of the vehicle body 10B by capturing the periphery, that is, the front side of the vehicle body 10B.

The vehicle body 10B includes a concave portion 10BU which is formed between the front and rear parts thereof. The concave portion 10BU is disposed between the vehicle wheel 12A and the vehicle wheel 12B. The vessel 11 is a member that loads the ore MR as the load thereon by the loading machine 30. At least a part of the vessel 11 is disposed in the concave portion 10BU.

In the embodiment, a part of the vehicle body 10B, disposed at one side of the axis AX of the vehicle body 10B in the front and rear direction of the vehicle body 10B is symmetrical (in the front and rear direction) to a part of the vehicle body 10B disposed at the other side. Further, a part of the vessel 11 disposed at one side of the central portion AX of the vehicle body 10B in the front and rear direction of the vehicle body 10B is symmetrical (in the front and rear direction) to a part of the vessel 11 disposed at the other side thereof. Further, the vehicle body 10B and the vessel 11 is symmetrical (in the left and right direction) with respect to the axis in the front and rear direction of the vehicle body 10B in the top view.

The vessel 11 includes a bottom surface 11B and four side surfaces 11SF, 11SR, 11SA, and 11SB connected to the bottom surface 11B. The side surfaces 11SA and 11SB are formed uprightly from the bottom surface 11B. The side surfaces 11SF and 11SR are respectively inclined toward the vehicle wheels 12A and 12B with respect to the bottom surface 11B. A concave portion 11U is formed by the bottom surface 11B and four side surfaces 11SF, 11SR, 11SA, and 11SB. The ore MR as the load is loaded on the concave portion 11U. The concave portion 10BU of the vehicle body 10B has a shape following the outer shape of the vessel 11. Next, the support structure of the vessel 11 will be described.

Figure 9:
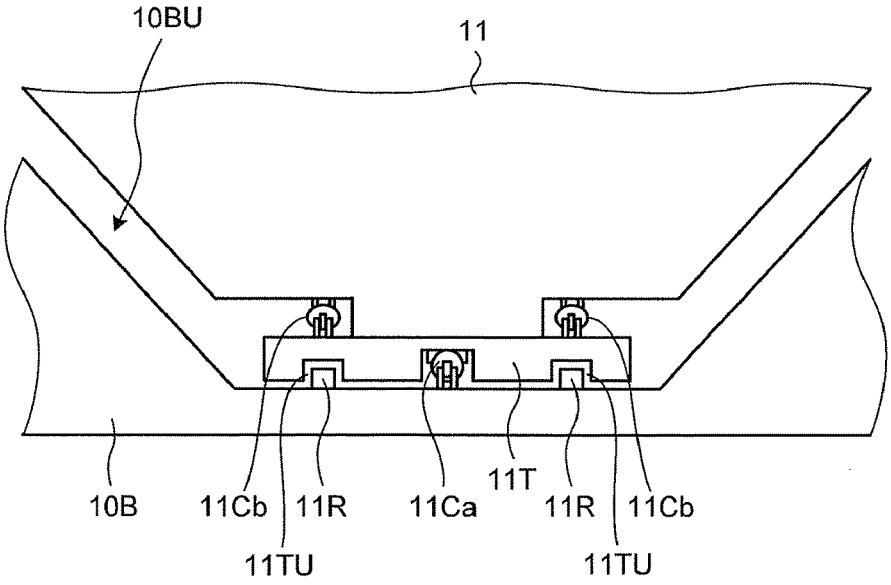
FIG. 9 is a diagram illustrating a vessel support structure of the transporting machine according to the embodiment.
Figure 10:
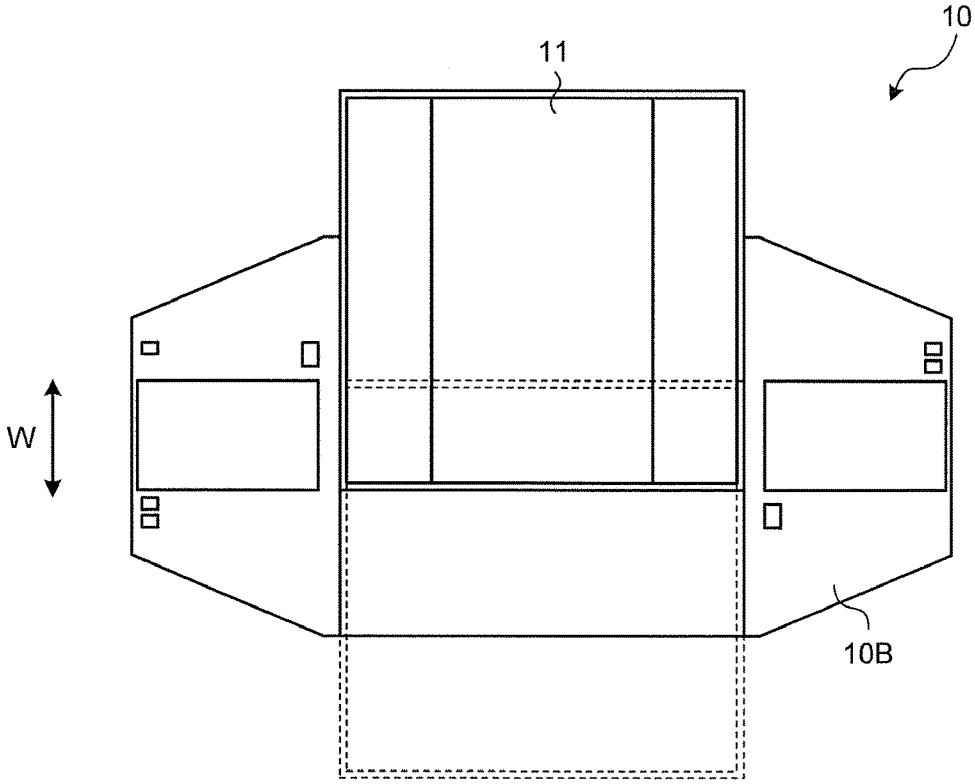
FIG. 10 is a top view of the transporting machine according to the embodiment.
Figure 11:
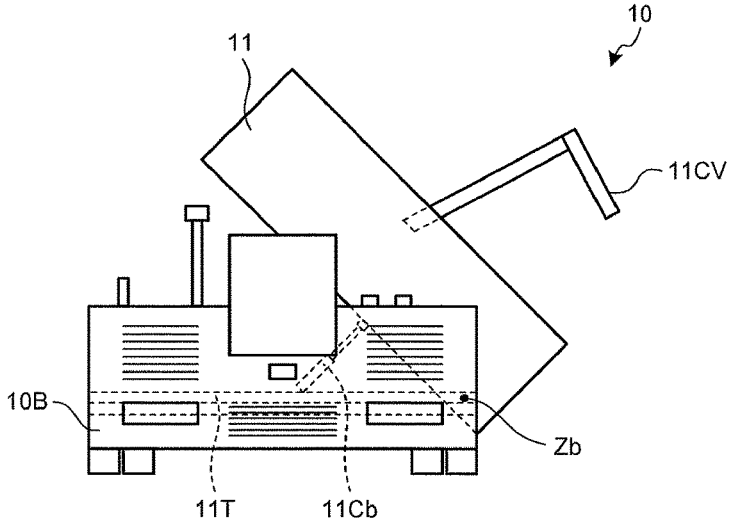
FIG. 11 is a diagram illustrating a state where a vessel of the transporting machine according to the embodiment is inclined.

FIG. 9 is a diagram illustrating the support structure of the vessel 11 of the transporting machine 10 according to the embodiment. FIG. 10 is a top view of the transporting machine 10 according to the embodiment. FIG. 11 is a diagram illustrating a state where the vessel of the transporting machine 10 according to the embodiment is inclined. The vessel 11 is placed on the upper surface of a table 11T through a hydraulic cylinder (a hoist cylinder) 11Cb serving as an actuator elevating the vessel 11.

The table 11T is supported by the vehicle body 10B through a pair of support bodies 11R and 11R provided on the upper surface of the concave portion 10BU of the vehicle body 10B. The support body 11R is a bar-shaped member that extends in the width direction of the vehicle body 10B. The support bodies 11R and 11R are respectively fitted to a pair of grooves 11TU and 11TU provided in a part facing the vehicle body 10B in the table 11T. The grooves 11TU and 11TU are provided in the extension direction of the support body 11R, that is, the width direction of the vehicle body 10B. With such a structure, the table 11T moves along the support bodies 11R and 11R. That is, the table 11T can move in the width direction of the vehicle body 10B of the transporting machine 10.

A hydraulic cylinder (a sliding cylinder) 11Ca as an actuator moving the table 11T in the width direction of the vehicle body 10B is attached between the table 11T and the vehicle body 10B. When the hydraulic cylinder 11Ca moves in a telescopic manner, the table 11T moves toward both sides of the vehicle body 10B in the width direction. Since the vessel 11 is attached to the table 11T, the vessel 11 also can move toward both sides in the width direction W of the vehicle body 10B along with the table 11T as illustrated in FIG. 10.

When the ore MR is loaded from the loading machine 30 onto the vessel 11, the vessel 11 moves toward the loading machine 30 as illustrated in FIG. 5. With such a configuration, the transporting machine 10 can reliably load the ore MR onto the vessel 11. Further, when the ore MR is not uniformly loaded so as to be biased toward one side of the vessel 11, the transporting machine 10 can suppress the non-uniform loading of the ore MR by moving the vessel 11 in a reciprocating manner in the width direction of the vehicle body 10B so as to disperse the ore MR in the entire vessel 11.

The vessel 11 is elevated by the telescopic movement of the hydraulic cylinder 11Cb. FIG. 11 illustrates a state where the hydraulic cylinder 11Cb is lengthened so that the vessel 11 is inclined. As illustrated in FIG. 11, the vessel 11 swings about one axis Zb in the width direction W of the vehicle body 10B. The axis Zb is inclined in the table 11T and is parallel to the front and rear direction of the vehicle body 10B. When the hydraulic cylinder 11Cb is lengthened, the vessel 11 protrudes from the concave portion 10BU of the vehicle body 10B while the opposite side to the axis Zb increases in height. As a result, the vessel 11 is inclined and a cover 11CV near the axis Zb is opened so that the ore MR is discharged from the axis Zb side. When the hydraulic cylinder 11Cb is shortened, the vessel 11 enters the concave portion 10BU of the vehicle body 10B. The cover 11CV is synchronized with the elevating operation of the vessel 11 by a link mechanism (not illustrated).

In the embodiment, the vessel 11 only swings about the axis Zb existing at one side in the width direction W of the vehicle body 10B, but the invention is not limited thereto. For example, the vessel 11 may swing about another axis existing at the other side and parallel to the front and rear direction of the vehicle body 10B in addition to the axis Zb at one side of the vehicle body 10B. In this way, the transporting machine 10 can discharge the ore MR from both sides in the width direction W of the vehicle body 10B.

Figure 12:
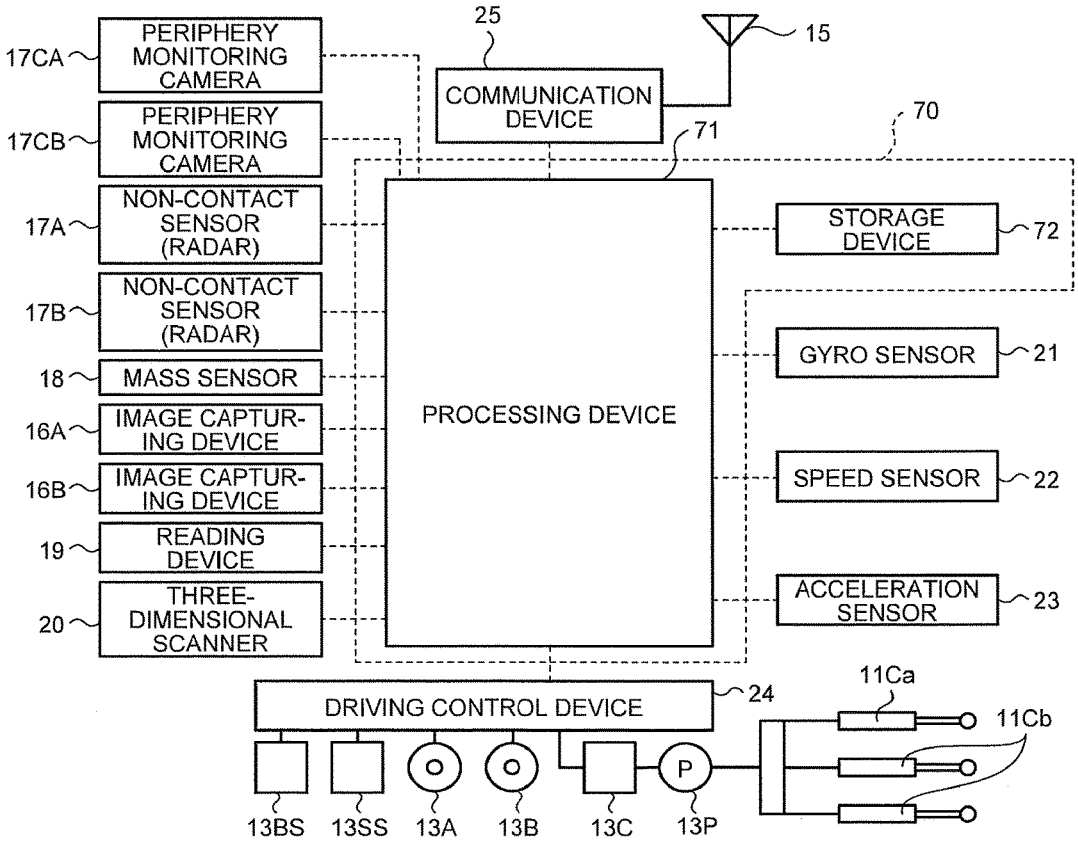
FIG. 12 is an example of a block diagram illustrating a control device of the transporting machine.

FIG. 12 is an example of a block diagram illustrating a control device 70 of the transporting machine 10. The control device 70 of the transporting machine 10 controls the traveling operation of the transporting machine 10 and the elevation and the movement in the width direction of the vessel 11. The control device 70 includes a processing device 71 and a storage device 72. The image capturing devices 16A and 16B, the non-contact sensors 17A and 17B, the periphery monitoring cameras 17CA and 17CB, a mass sensor 18, a reading device 19, a three-dimensional scanner 20, a gyro sensor 21, a speed sensor 22, an acceleration sensor 23, a driving control device 24, a communication device 25, and the storage device 72 are connected to the processing device 71.

Each of the image capturing devices 16A and 16B and the periphery monitoring cameras 17CA and 17CB includes an imaging element such as COD or CMOS and can detect the outer shape of an object by obtaining an optical image of the object. In the embodiment, at least one of the image capturing devices 16A and 16B and the periphery monitoring cameras 17CA and 17CB includes a stereo camera and can obtain the three-dimensional outer shape data of the object. The image capturing devices 16A and 16B and the periphery monitoring cameras 17CA and 17CB output an image capturing result to the processing device 71. The processing device 71 obtains the detection result of the image capturing devices 16A and 16B and obtains information on the state of the ore MR of the vessel 11 based on the detection result. In the embodiment, the outer shape of the ore MR loaded on the vessel 11 may be detected by at least one of the laser scanner and the three-dimensional distance sensor.

The non-contact sensors 17A and 17B are connected to the processing device 71 and output a detection result to the processing device 71. The non-contact sensors 17A and 17B output the obtained result to the processing device 71. The mass sensor 18 detects the mass of the vessel 11 and the mass of the ore MR loaded on the vessel 11. Since the mass of the vessel 11 is given, the mass of the ore MR loaded on the vessel 11 can be obtained when the mass of the vessel 11 is subtracted from the detection result of the mass sensor 18. The mass sensor 18 is connected to the processing device 71 and output a detection result to the processing device 71. The processing device 71 obtains information on whether the ore MR is loaded on the vessel 11 and the mass of the ore MR loaded on the vessel 11 based on the detection result of the mass sensor 18. The mass sensor 18 may be, for example, a strain gauge type load cell provided between the vessel 11 and the table 11T or a pressure sensor detecting the hydraulic pressure of the hydraulic cylinder 11Cb.

The reading device 19 detects identification information (original information) of a mark provided in the drift DR. The mark is disposed at a plurality of positions along the drift DR. The mark may be an identifier (a code) like a barcode and a two-dimensional code or may be an identifier (a tag) like an IC tag and an RFID. The reading device 19 is connected to the processing device 71 and outputs a detection result to the processing device 71.

The three-dimensional scanner 20 is attached to the outside, for example, the front and rear sides of the vehicle body 10B of the transporting machine 10, obtains spatial physical shape data around the transporting machine 10, and outputs the spatial physical shape data. The gyro sensor 21 detects the orientation (the orientation change amount) of the transporting machine 10 and outputs a detection result to the processing device 71. The speed sensor 22 detects the traveling speed of the transporting machine 10 and outputs a detection result to the processing device 71. The acceleration sensor 23 detects the acceleration of the transporting machine 10 and outputs a detection result to the processing device 71. The driving control device 24 is, for example, a microcomputer. The driving control device 24 controls the operation of the traveling motors 13A and 13B, a braking system 13BS, a steering system 13SS, and a motor 13C driving a hydraulic pump 13P based on the instruction from the processing device 71. The hydraulic pump 13P is a device which supplies hydraulic oil to the hydraulic cylinders 11Ca and 11Cb. In the embodiment, the transporting machine 10 travels by the traveling motors 13A and 13B, but the invention is not limited thereto. For example, the transporting machine 10 may travel by a hydraulic motor driven by the hydraulic oil ejected from the hydraulic pump 13P. The braking system 13BS and the steering system 13SS may be operated by electrical power or a hydraulic pressure.

In the embodiment, the information on the position (the absolute position) where the mark is disposed in the drift DR is given information measured in advance. The information on the absolute position of the mark is stored in the storage device 72. The processing device 71 can obtain the absolute position of the transporting machine 10 in the drift DR based on the storage information of the storage device 72 and the detection result of the mark (the identification information of the mark) detected by the reading device 19 provided in the transporting machine 10.

The three-dimensional scanner 20 includes a scan type electronic distance meter capable of outputting the spatial physical shape data. The three-dimensional scanner 20 includes, for example, at least one of a laser scanner and a three-dimensional distance sensor and can obtain and output two-dimensional or three-dimensional space data. The three-dimensional scanner 20 detects at least one of the loading machine 30 and the wall surface of the drift DR. In the embodiment, the three-dimensional scanner 20 can obtain at least one of the shape data of the loading machine 30, the wall surface shape data of the drift DR, and the load shape data of the vessel 11. Further, the three-dimensional scanner 20 can detect at least one of the relative position (the relative distance and the orientation) with respect to the loading machine 30 and the relative position with respect to the wall surface of the drift DR. The three-dimensional scanner 20 outputs the detected information to the processing device 71.

In the embodiment, the information on the wall surface of the drift DR is obtained in advance and is stored in the storage device 72. That is, the information on the wall surface of the drift DR is given information measured in advance. The information on the wall surface of the drift DR includes information on the shapes of a plurality of parts of the wall surface and information on the absolute positions of the parts of the wall surface. The storage device 72 store a relation of the shapes of the plurality of parts of the wall surface with respect to the absolute positions of the parts of the wall surface having the shape. The processing device 71 can obtain the absolute position and the orientation of the transporting machine 10 of the drift DR based on the storage information of the storage device 72 and the detection result (the wall surface shape data) of the wall surface of the drift DR detected by the three-dimensional scanner 20 provided in the transporting machine 10.

The processing device 71 controls the transporting machine 10 traveling in the drift DR so that the transporting machine 10 travels along the determined course (the target course) in the underground mine MI based on the current position (the absolute position) of the transporting machine 10 derived by at least one of the reading device 19 and the three-dimensional scanner 20.

The processing device 71 is, for example, a microcomputer including a CPU. The processing device 71 controls the traveling motors 13A and 13B, the braking system 13BS, and the steering system 13SS of the vehicle wheels 12A and 12B through the driving control device 24 based on the detection result of the non-contact sensors 17A and 17B, the reading device 19, and the three-dimensional scanner 20. Then, the processing device 71 causes the transporting machine 10 to travel along the target course at a predetermined traveling speed and a predetermined acceleration.

The storage device 72 includes at least one of a RAM, a ROM, a flash memory, and a hard disk drive and is connected to the processing device 71. The storage device 72 stores a computer program and various kinds of information necessary when the processing device 71 causes the transporting machine 10 to travel autonomously. The communication device 25 is connected to the processing device 71 and communicates with at least one of the communication device and the management device 3 mounted on the loading machine 30 according to a data communication.

In the embodiment, the transporting machine 10 is an unmanned vehicle and can travel autonomously. The communication device 25 can receive information (including an instruction signal) transmitted from at least one of the management device 3 and the loading machine 30. Further, the communication device 25 can transmit the information detected by the image capturing devices 16A and 16B, the periphery monitoring cameras 17CA and 17CB, the speed sensor 22, and the acceleration sensor 23 to at least one of the management device 3 and the loading machine 30. The transporting machine 10 transmits the peripheral information of the transporting machine 10 obtained by at least one of the periphery monitoring cameras 17CA and 17CB and the non-contact sensors 17A and 17B to the management device 3. Accordingly, an operator can remotely operate the transporting machine 10 based on the peripheral information. Likewise, the transporting machine 10 travels autonomously and travels even by the operation of the operator. Further, the vessel 11 can be slid and elevated.

For example, the management device 3 which obtains the information detected by the speed sensor 22 and the acceleration sensor 23 stores the information as the operation information of the transporting machine 10 in, for example, the storage device 3M. Further, when the management device 3 obtains the information captured by the periphery monitoring cameras 17CA and 17CB, the operator can operate the transporting machine 10 while seeing the peripheral image of the transporting machine 10 captured by the periphery monitoring cameras 17CA and 17CB. Further, the loading machine 30 which obtains the information on the mass of the ore MR of the vessel 11 detected by the mass sensor 18 can control the amount of the ore MR loaded on the vessel 11 based on the information. Next, the loading machine 30 will be described.

<Loading Machine 30>

Figure 13:
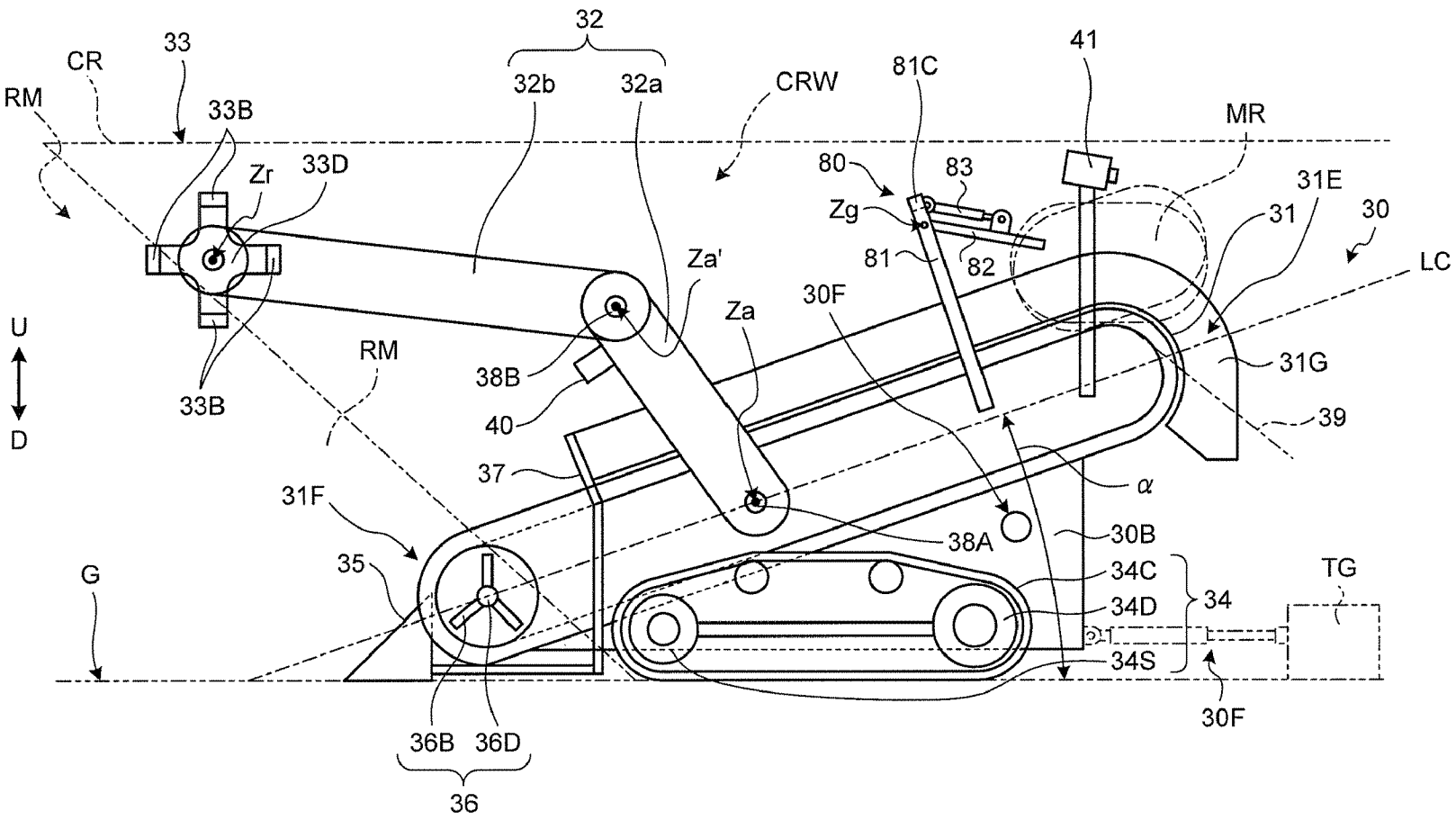
FIG. 13 is a side view of a loading machine according to the embodiment.
Figure 14:
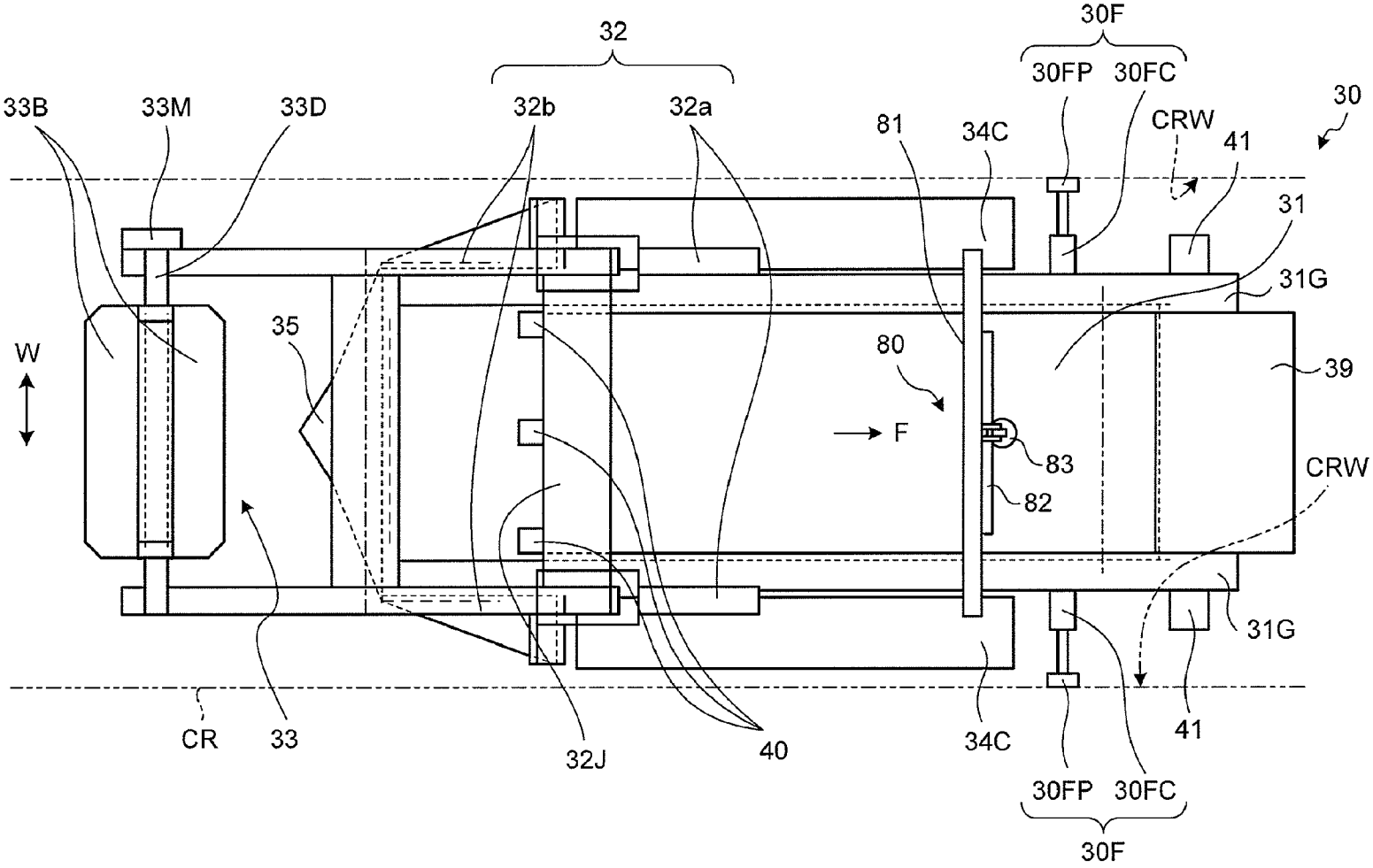
FIG. 14 is a top view of the loading machine according to the embodiment.
Figure 15:
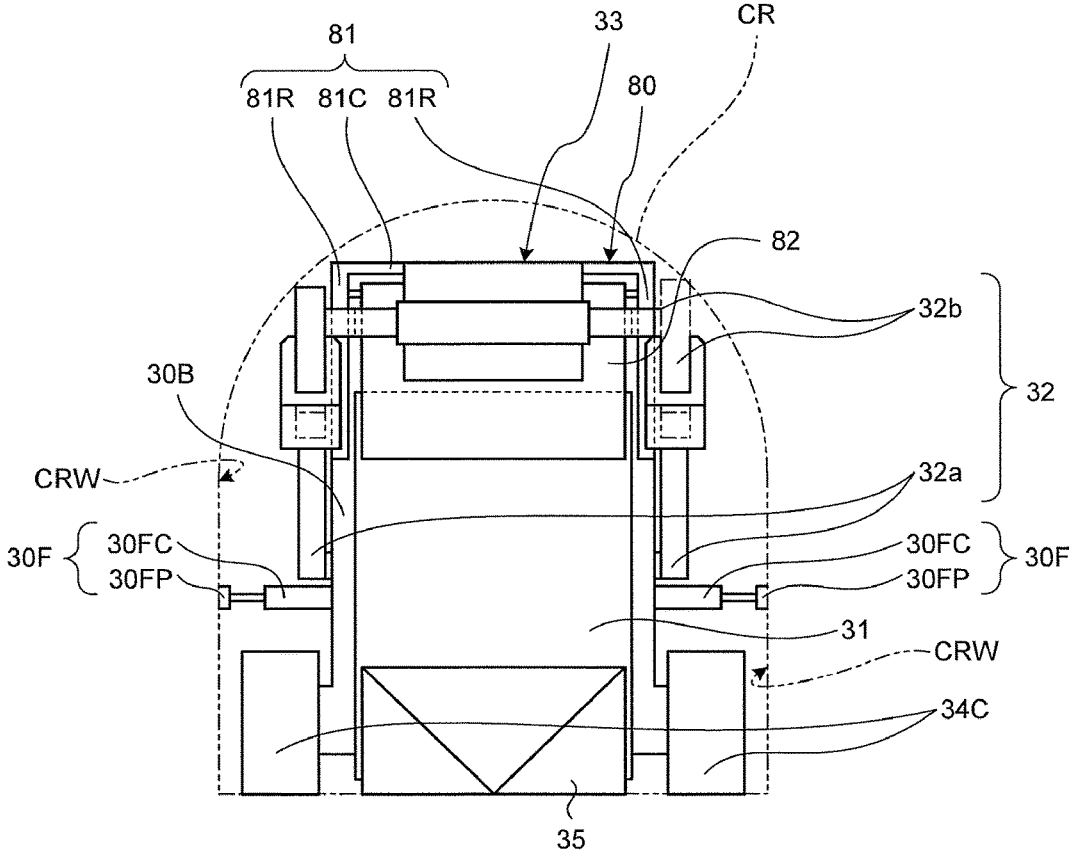
FIG. 15 is a front view of the loading machine according to the embodiment.

FIG. 13 is a side view of the loading machine 30 according to the embodiment. FIG. 14 is a top view of the loading machine 30 according to the embodiment. FIG. 15 is a front view of the loading machine 30 according to the embodiment. FIG. 13 illustrates a state where the loading machine 30 excavates the ore MR of the rock mass RM and conveys the excavated ore MR. The loading machine 30 excavates the rock mass RM of the ore MR inside the cross cut CR and loads the excavated ore MR onto the vessel 11 of the transporting machine 10 illustrated in FIGS. 7 and 8. The feeder 31, the support mechanism 32, the traveling device 34, the penetration member 35, the rotation body 36, and the rock guard 37 are attached to the vehicle body 30B of the loading machine 30. The attachment side of the penetration member 35 is the front side of the loading machine 30, and the opposite side to the attachment side of the penetration member 35 is the rear side of the loading machine 30. Further, the loading machine 30 may not include the rotation body 36 and the rock guard 37.

The feeder 31 loads the ore MR from the rock mass RM and conveys the ore in a direction moving away from the rock mass RM of the draw point DP so as to discharge the ore. That is, the feeder 31 conveys the ore MR loaded at the front side of the loading machine 30 backward so as to discharge the ore backward. The feeder 31 conveys the ore MR from a loading side 31F toward a discharging side 31E, for example, by using a conveyor belt as an endless conveyor, winding the conveyor belt on a pair of rollers, and rotating the conveyor belt. The loading side 31F is near the rock mass RM, and the discharging side 31E is opposite to the loading side 31F. As illustrated in FIG. 14, the feeder 31 has a configuration in which a pair of guides 31G and 31G is provided at both sides in the width direction W. The pair of guides 31G and 31G is used to suppress the ore MR from being dropped from the feeder 31 in a conveying state. The width direction W is a direction orthogonal to a conveying direction F in which the feeder 31 conveys the ore MR and is a direction parallel to the rotation axes of the pair of rollers of the feeder 31. The width direction W of the feeder 31 is also the width direction of the vehicle body 30B. The feeder 31 includes a guide 39 which is provided at the discharging side 31E so as to guide the ore MR into the vessel 11 of the transporting machine 10. The feeder 31 swings about the axis of the front side of the vehicle body 30B, that is, the loading side 31F of the feeder 31. The feeder 31 can change an angle α with respect to a ground surface G. The angle α is an angle formed between the ground surface G and a line LC connecting the rotation axes of the pair of rollers of the feeder 31.

The ore MR are loaded onto the feeder 31 by the rotation roller 33. The rotation roller 33 feeds the ore MR toward the feeder 31 while rotating at the loading side 31F of the feeder 31, that is, the front side of the feeder 31. For this reason, the rotation roller 33 is provided at the loading side 31F of the feeder 31 by the support mechanism 32 including the boom 32*a* and the arm 32*b* for the operation of excavating the ore. The rotation roller 33 includes a rotation member 33D rotating about a predetermined axis Zr and a contact member 33B provided in the outer periphery of the rotation member 33D so as to excavate the ore MR in a contact state. In the embodiment, the contact member 33B is provided as a plurality of plate-shaped members that protrudes outward in the radial direction from the rotation member 33D and is provided at a predetermined interval along the circumferential direction of the rotation member 33D. The plane parallel to the plate surface of the contact member 33B is not orthogonal to the axis Zr. In the embodiment, the plane parallel to the plate surface of the contact member 33B is parallel to the axis Zr. The contact member 33B may be bent so that the front end, that is, the end opposite to the rotation member 33D is bitten into the rock mass RM as an excavating target.

When the rotation roller 33 rotates, the contact member 33B moves away from the feeder 31 at the position of the upside U and moves close to the feeder 31 at the position of the downside D. By this movement, the contact members 33B excavate the ore MR from the rock mass RM and feed the ore to the feeder 31. Since the contact members 33B rotate along with the rotation member 33D, the ore MR can be continuously excavated and fed to the feeder 31.

The support mechanism 32 which rotatably supports the rotation roller 33 includes the boom 32*a* attached to the vehicle body 30B and the arm 32*b* connected to the boom 32*a*. The boom 32*a* is attached to the vehicle body 30B of the loading machine 30 through, for example, a shaft 38A and swings about the shaft 38A with respect to the vehicle body 30B. The arm 32*b* is connected to the end opposite to the vehicle body 30B of the boom 32*a* through, for example, a shaft 38B and swings about the shaft 38B with respect to the boom 32*a*. The arm 32*b* rotatably supports the rotation roller 33 by the end opposite to the end connected to the boom 32*a*. For example, the boom 32*a* and the arm 32*b* may swing while being driven by a hydraulic cylinder as an actuator or may swing while being driven by a motor or a hydraulic motor.

The boom 32*a* swings about the first axis Za with respect to the vehicle body 30B, and the arm 32*b* swings about the axis Za' parallel to the first axis Za. The first axis Za is the axis of the shaft 38A connecting the boom 32*a* and the vehicle body 30B to each other, and the axis Za' parallel to the first axis Za is the axis of the shaft 38B connecting the boom 32*a* and the arm 32*b* to each other. In the embodiment, the arm 32*b* may further swing about the axis parallel to the second axis orthogonal to the first axis Za. In this way, since the movement range of the rotation roller 33 increases, the degree of freedom of the excavating work is improved.

The boom 32*a* corresponds to a pair of bar-shaped members (first bar-shaped members) provided at both sides of the vehicle body 30B in the width direction W, that is, both sides of the feeder 31 in the width direction W in the embodiment. The arm 32*b* corresponds to a pair of bar-shaped members (second bar-shaped members) respectively connected to the booms 32*a*. As illustrated in FIG. 14, the pair of arms 32*b* supports the rotation roller 33 therebetween. In the embodiment, the pair of booms 32*a* is connected to each other by a beam 32J. With such a structure, since the rigidity of the support mechanism 32 is improved, the support mechanism 32 can reliably press the rotation roller 33 against the rock mass RM when the ore MR is excavated. Accordingly, it is possible to suppress degradation in efficiency of excavating the ore MR. Further, the pair of arms 32*b* may be connected to each other by a bar-shaped member or a plate-shaped member. In this way, it is more desirable in that the rigidity of the support mechanism 32 is further improved.

In the support mechanism 32, the boom 32*a* swings about the vehicle body 30B and the arm 32*b* swings about the boom 32*a*, so that the rotation roller 33 moves. Since the support mechanism 32 moves the rotation roller 33, the relative positional relation among the rotation roller 33, the feeder 31, and the vehicle body 30B can be changed. Further, in the support mechanism 32, different positions of the rock mass RM can be excavated by the movement of the rotation roller 33 or the ore MR can be raked from the rock mass RM to the feeder 31 by the movement of the rotation roller 33 from the rock mass RM toward the feeder 31. Further, for example, when an object exists at the front side of the traveling loading machine 30 so that the traveling operation is disturbed, the support mechanism 32 rakes the object toward the feeder 31 by the rotation roller 33 so as to feed the object to the feeder 31. Accordingly, the object at the front side in the traveling direction of the loading machine 30 can be removed.

In the embodiment, the rotation roller 33 is rotated by a motor 33M attached to the front end of the arm 32*b* as illustrated in FIG. 14. A device for driving the rotation roller 33 is not limited to the motor 33M and may be, for example, a hydraulic motor. Further, the attachment position of the motor 33M is not limited to the front end of the arm 32*b*.

The vehicle body 30B is equipped with the traveling device 34 causing the vehicle body to travel.

The traveling device 34 includes a pair of crawlers 34C which is provided at both sides of the vehicle body 30B in the width direction, a pair of drive wheels 34D which is provided at both sides of the vehicle body 30B in the width direction, and a pair of driven wheels 34S which is provided at both sides of the vehicle body 30B in the width direction. The crawlers 34C are wound around the drive wheels 34D and the driven wheels 34S. Each drive wheel 34D is driven separately and independently. In the embodiment, the loading machine 30 includes a traveling motor provided in each drive wheel 34D. With such a structure, the pair of crawlers 34C and 34C is separately and independently driven.

The penetration member 35 is attached to the vehicle body 30B. The penetration member 35 is disposed at the loading side 31F of the feeder 31 of the vehicle body 30B. The penetration member 35 is a pyramid-shaped member and has a quadrangular pyramid shape in the embodiment. The shape of the penetration member 35 is not limited to the quadrangular pyramid shape and may be, for example, a triangular pyramid shape. The penetration member 35 is attached to the vehicle body 30B so that the apex of the pyramid is located at the front side of the vehicle body 30B. With such a configuration, when the loading machine 30 penetrates the rock mass RM, the penetration member 35 penetrates the rock mass RM from the apex thereof.

During the excavating operation of the loading machine 30, the penetration member 35 penetrates the rock mass RM from the apex of the pyramid so that the rock mass RM is broken. When the penetration member 35 penetrates the rock mass RM, the traveling device 34 causes the penetration member 35 to penetrate the rock mass RM while the vehicle body 30B equipped with the feeder 31 and the penetration member 35 is caused to travel forward and the feeder 31 is operated. At this time, the upper conveyor belt of the feeder 31 moves from the loading side 31F toward the discharging side 31E. Since the loading machine 30 operates the feeder 31 in this way during the penetration operation, the driving force of the feeder 31 can be used for the penetration, and hence the rock mass RM can be more deeply penetrated.

The pair of rotation bodies 36 is provided at both sides of the vehicle body 30B in the width direction, that is, both sides of the feeder 31 in a direction orthogonal to the conveying direction. The pair of rotation bodies 36 is disposed at the front side of the traveling device 34 so as to be located at the loading side 31F of the feeder 31. The rotation bodies 36 have a structure in which a plurality of blades 36B is provided at a predetermined interval around a drum 36D rotating about a predetermined axis. The rotation body 36 is driven by, for example, a motor. The rotation body 36 may be driven by a motor driving the feeder 31. In this case, the driving of the feeder 31 and the driving of the rotation body 36 may be switched by a clutch or the like. For example, when the clutch is engaged, the feeder 31 and the rotation body 36 rotate at the same time. Meanwhile, when the clutch is disengaged, only the feeder 31 rotates.

When the penetration member 35 penetrates the rock mass RM, the rotation body 36 rotates in a direction in which the vehicle body 30B of the loading machine 30 is pressed against the ground surface G. Specifically, the rotation body 36 rotates so that the blade 36B near the rock mass RM is directed from the downside D to the upside U and the blade 36B near the traveling device 34 is directed from the upside U to the downside D. With such a configuration, since the rotation body 36 presses the front side of the vehicle body 30B toward the downside D when the blade 36B near the rock mass RM contacts the rock mass RM, the crawler 34C of the traveling device 34 is more strongly pressed against the ground surface G. As a result, since a friction force between the crawler 34C and the ground surface G increases, the traveling device 34 can cause the penetration member 35 to easily penetrate the rock mass RM. When the penetration of the loading machine 30 into the rock mass RM is ended and the excavating operation is started by the rotation roller 33 so that the excavated ore is loaded onto the feeder 31, the rotation of the rotation body 36 is stopped.

The rock guard 37 is provided between the rotation body 36 and the crawler 34C of the traveling device 34. In the embodiment, the rock guard 37 is attached to the vehicle body 30B. For example, the rock guard 37 is used to protect the traveling device 34 from the ore MR flying from the rotation roller 33 in the excavating state or to protect the traveling device 34 from the rock existing inside the mine shaft when the loading machine 30 travels. Due to the rock guard 37, degradation in durability of the traveling device 34 is suppressed.

In the embodiment, the vehicle body 30B includes a fixing device 30F which extends outward in the width direction of the vehicle body 30B and is pressed against the wall surface CRW of the cross cut CR connected to the draw point DP. In the embodiment, the fixing device 30F is provided at each of both sides of the vehicle body 30B in the width direction so that the fixing devices face each other, but the number and the installation positions of the fixing devices 30F are not limited thereto. For example, the fixing device 30F may be provided at the upside of the vehicle body 30B. In the embodiment, the fixing device 30F includes, for example, a hydraulic cylinder 30FC and a pressing member 30FP provided at the front end of the piston of the hydraulic cylinder 30FC. When the loading machine 30 excavates and conveys the ore MR, the fixing device 30F fixes the loading machine 30 into the cross cut CR. Specifically, the fixing device 30F lengthens the hydraulic cylinder 30FC so that the pressing member 30FP is pressed against the wall surface CRW, so that the vehicle body 30B of the loading machine 30 is fixed into the cross cut CR through the fixing device. With such a configuration, a reaction force which is generated when the loading machine 30 excavates the rock mass RM can be received by the cross cut CR through the fixing device 30F. As a result, since the posture of the loading machine 30 is stabilized, the rock mass RM can be stably excavated. A configuration may be employed in which a hydraulic cylinder is provided between the fixing device 30F and the vehicle body 30B, the fixing device 30F is fixed to the wall surface CRW of the cross cut CR, and the penetration of the vehicle body is caused by the driving force of the hydraulic cylinder.

When the fixing device 30F is provided at both sides of the vehicle body 30B in the width direction or the upside thereof, the fixing operation of the fixing device 30F is released during the penetration of the loading machine 30. In the embodiment, the hydraulic cylinder 30FC is shortened so that the pressing member 30FP does not press the wall surface CRW. During the excavating operation of the loading machine 30, the fixing device 30F is operated so as to fix the loading machine 30 into the cross cut CR. When the loading machine 30 further penetrates the rock mass RM or is separated from the rock mass RM during the excavating operation, the fixing operation of the fixing device 30F is released and the traveling device 34 moves the loading machine 30.

As illustrated in FIG. 13, the fixing device 30F may be provided at the rear side of the vehicle body 30B, that is, the discharging side 31E of the feeder 31. Then, the reaction force may be received through the fixing device 30F between the vehicle body 30B and a reaction force receiving portion TG protruding from the ground surface G inside the cross cut CR. During the excavating operation, the reaction force of the loading machine 30 in the front and rear direction is large. However, in such a structure, the reaction force can be more effectively received during the excavating operation. Further, the loading machine 30 can adjust the position of the loading machine 30 during the excavating operation by lengthening the fixing device 30F. In addition, the loading machine 30 may not include the fixing device 30F.

In the embodiment, the loading machine 30 includes a switching mechanism 80 which is provided between a part (the loading side 31F) loading the ore MR thereon in the feeder 31 and a part (the discharging side 31E) discharging the ore MR from the feeder 31 so as to discharge or not to discharge the ore MR. The switching mechanism 80 includes a support body 81, a cover 82, and a hydraulic cylinder 83 serving as an actuator opening and closing the cover 82. As illustrated in FIG. 15, the support body 81 is a door-shaped member including two leg portions 81R of which one ends are attached to both sides of the vehicle body 30B in the width direction, that is, both sides of the feeder 31 in the width direction and a connection portion 81C which connects the other ends of two leg portions 81R. The ore MR passes through a part surrounded by two leg portions 81R and the connection portion 81C.

The cover 82 is a plate-shaped member and is provided in the portion surrounded by two leg portions 81R and the connection portion 81C. The cover 82 rotates about a predetermined axis Zg existing near the connection portion 81C of the support body 81. The hydraulic cylinder 83 is provided between the cover 82 and the connection portion 81C of the support body 81. When the hydraulic cylinder 83 moves in a telescopic manner, the cover 82 opens or closes the portion surrounded by two leg portions 81R and the connection portion 81C. When the cover 82 is opened, the ore MR passes through the portion surrounded by two leg portions 81R and the connection portion 81C. When the cover 82 is closed, the ore MR does not pass through the portion surrounded by two leg portions 81R and the connection portion 81C. With such a configuration, the loading machine 30 can adjust the amount of the ore MR discharged from the feeder 31.

In the embodiment, the loading machine 30 includes an information collecting device 40. The information collecting device 40 is attached to the loading side 31F, that is, the front side of the vehicle body 30B. More specifically, a part collecting information by the information collecting device 40 is attached toward the loading side 31F, that is, the front side of the vehicle body 30B. The information collecting device 40 is a device that obtains and outputs three-dimensional space data. The information collecting device 40 obtains ore information as the information on the state of the ore MR of the rock mass RM. The ore information corresponds to the three-dimensional space data of the rock mass RM.

The information collecting device 40 is, for example, a camera, a stereo camera, a laser scanner, or a three-dimensional distance sensor. A part collecting information by the information collecting device 40 is a lens in the case of the camera or the stereo camera or a light receiving portion in the case of the laser scanner and the three-dimensional distance sensor. In the embodiment, the stereo camera is used as the information collecting device 40. In the embodiment, the loading machine 30 attaches three information collecting devices 40 to the beam 32J of the support mechanism 32. That is, the information collecting devices 40 are provided at a plurality of positions of the vehicle body 30B in the width direction. With such a configuration, the loading machine 30 can obtain image capturing target ore information by the other information collecting device 40 even when the image capturing target of one information collecting device 40 is hidden by the arm 32*b*.

In the embodiment, the control device of the loading machine 30 controls the operation of the loading machine 30 by using the ore information collected by the information collecting device 40. For example, the control device controls at least one of the feeder 31, the rotation roller 33, the support mechanism 32, and the traveling device 34 based on the ore information obtained by the information collecting device 40. With such a configuration, since the loading machine 30 can be operated flexibly in response to the state of the rock mass RM and the ore MR, for example, the production efficiency of the mine M is improved.

In the embodiment, the loading machine 30 includes an information collecting device 41 which is provided at the discharging side 31E, that is, the rear side of the vehicle body 30B. More specifically, a part collecting information by the information collecting device 41 is attached toward the discharging side 31E, that is, the rear side of the vehicle body 30B. The information collecting device 41 is a device that obtains and outputs three-dimensional space data similarly to the information collecting device 40. The information collecting device 41 obtains load information as the information on the state of the ore MR loaded on the vessel 11 of the transporting machine 10 illustrated in FIGS. 4 and 5. The load information corresponds to the three-dimensional space data of the ore MR.

Similarly to the information collecting device 40, the information collecting device 41 is, for example, a camera, a stereo camera, a laser scanner, or a three-dimensional distance sensor. A part collecting information by the information collecting device 41 is a lens in the case of the camera or the stereo camera or a light receiving portion in the case of the laser scanner and the three-dimensional distance sensor. In the embodiment, the stereo camera is used as the information collecting device 41. In the embodiment, the loading machine 30 includes two information collecting devices 41 attached to both sides of the feeder 31 in the width direction. That is, the information collecting devices 41 are provided at a plurality of positions of the vehicle body 30B in the width direction. With such a configuration, the loading machine 30 can obtain the image capturing target ore information by the other information collecting device 41 even when the image capturing target of one information collecting device 41 is hidden by the shade of the mine shaft.

In the embodiment, the control device of the loading machine 30 controls at least one of the loading machine 30 and the transporting machine 10 by using the load information collected by the information collecting device 41. For example, the control device is used to control the operation of the rotation roller 33, the feeder 31, or the switching mechanism 80 or to control the movement of the vessel 11 or the position of the vessel 11 of the transporting machine 10 based on the load information obtained by the information collecting device 41. With such a configuration, since the loading machine 30 can adjust the position of the vessel 11 or change the conveying amount of the ore MR in response to the state of the ore MR loaded on the vessel 11 of the transporting machine 10, for example, the production efficiency of the mine M is improved.

Figure 16:
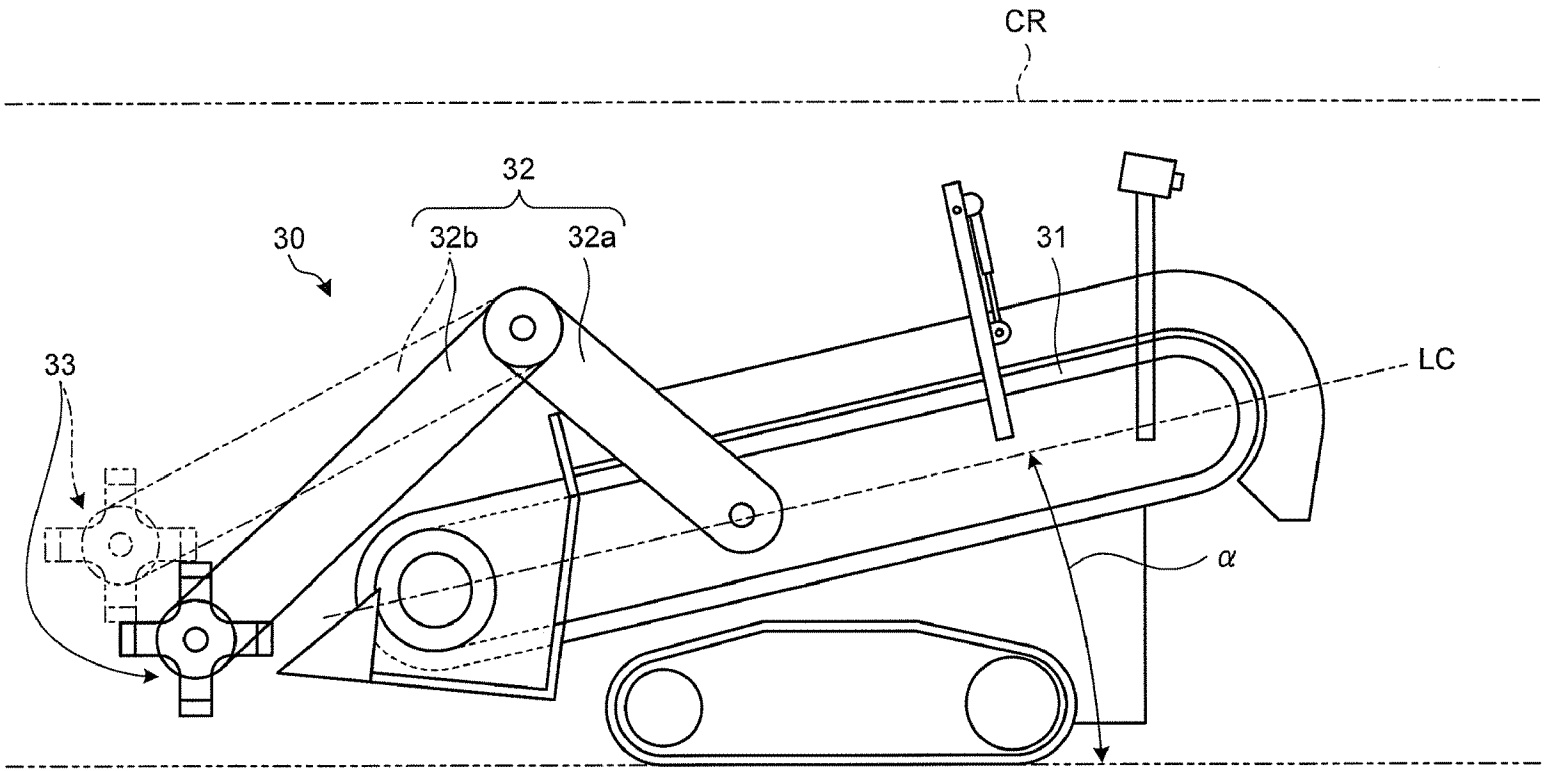
FIG. 16 is a diagram illustrating a posture obtained when the loading machine according to the embodiment travels.

FIG. 16 is a diagram illustrating a posture obtained when the loading machine 30 according to the embodiment travels. When the loading machine 30 travels, the angle $\alpha$ of the feeder 31 with respect to the ground surface G decreases compared with the case (see FIG. 13) in which the loading machine 30 excavates and conveys the ore MR. That is, the line LC connecting the rotation axes of the pair of rollers of the feeder 31 is substantially parallel to the ground surface G. In this way, since the loading side 31F of the feeder 31 disposed at the front side of the loading machine 30, that is, the advancing side is separated from the ground surface, it is possible to reduce the possibility of the interference between the feeder 31 and the ground surface G when the loading machine 30 travels.

As illustrated in FIG. 16, the support mechanism 32 is folded when the loading machine 30 travels. Then, the rotation roller 33 moves to a position closer to the feeder 31 compared with the case where the loading machine 30 excavates and conveys the ore MR (see FIG. 13). For this reason, the balance of mass of the loading machine 30 in the front and rear direction is improved in that the rotation roller 33 existing at a position separated from the center in the front and rear direction of the vehicle body 30B moves closer to the center. As a result, the loading machine 30 can stably travel.

Figure 17:
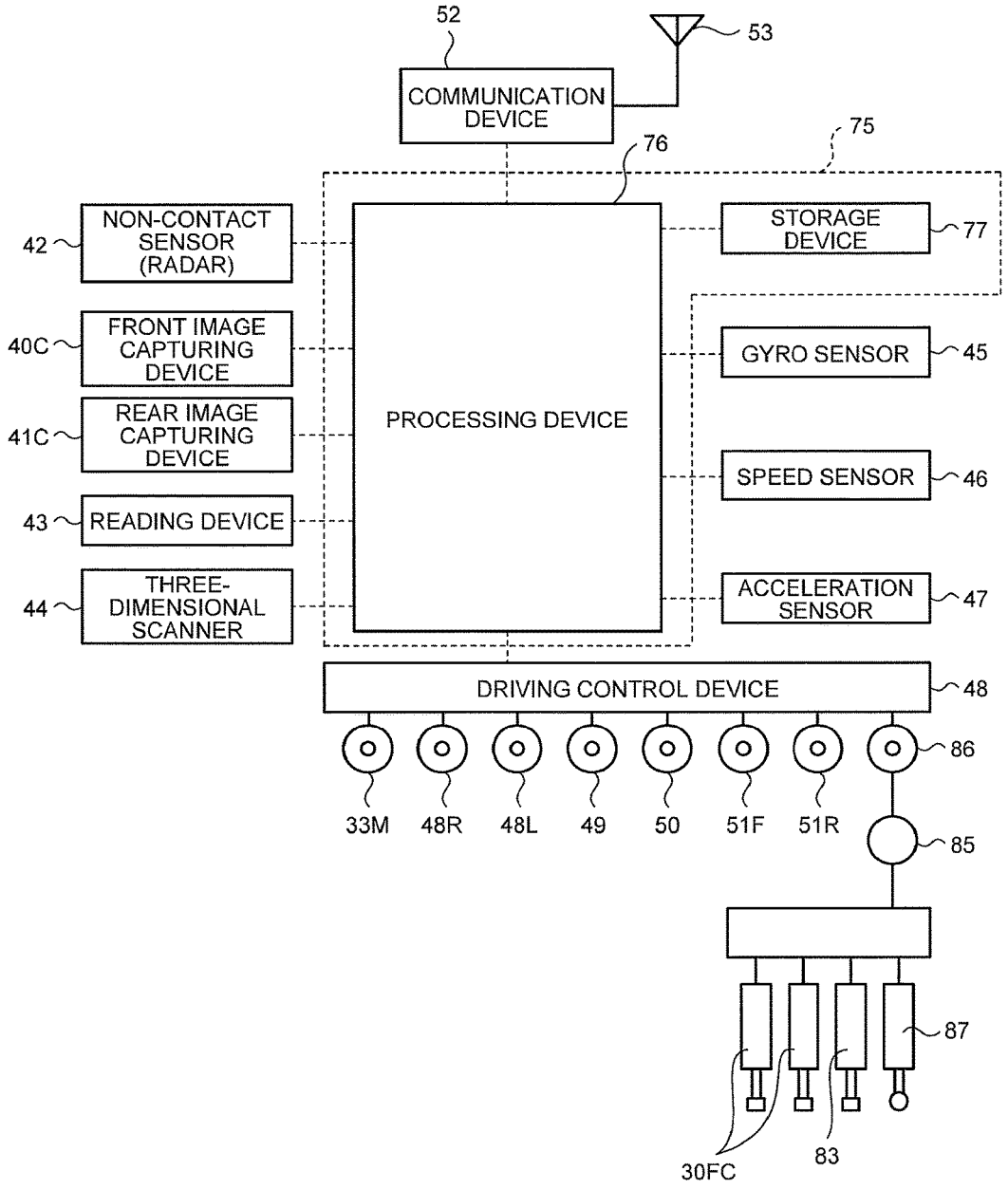
FIG. 17 is an example of a block diagram illustrating a control device of the loading machine according to the embodiment.

FIG. 17 is an example of a block diagram illustrating a control device 75 of the loading machine 30 according to the embodiment. The control device 75 of the loading machine 30 controls the feeder 31, the support mechanism 32, the rotation roller 33, the traveling device 34, the rotation body 36, and the switching mechanism 80. The control device 75 includes a processing device 76 and a storage device 77. A front image capturing device 40C corresponding to the information collecting device 40, a rear image capturing device 41C corresponding to the information collecting device 41, a non-contact sensor 42, a reading device 43, a three-dimensional scanner 44, a gyro sensor 45, a speed sensor 46, an acceleration sensor 47, a driving control device 48, a communication device 52, and the storage device 77 are connected to the processing device 76. The non-contact sensor 42, the reading device 43, and the three-dimensional scanner 44 are attached to the outside of the vehicle body 30B of the loading machine 30.

Each of the front image capturing device 40C and the rear image capturing device 41C includes an imaging element such as a CCD or a CMOS and can detect the outer shape of an object by obtaining an optical image of the object. In the embodiment, each of the front image capturing device 40C and the rear image capturing device 41C includes a stereo camera and can obtain three-dimensional outer shape data of an object. The front image capturing device 40C and the rear image capturing device 41C output the image capturing result to the processing device 76. The processing device 76 obtains the detection result of the front image capturing device 40C and obtains the ore information based on the detection result. Further, the processing device 76 obtains the detection result of the rear image capturing device 41C and obtains the load information based on the detection result. In the embodiment, the outer shape of the ore MR of the rock mass RM and the outer shape of the ore MR loaded on the vessel 11 may be detected by at least one of a laser scanner and a three-dimensional distance sensor.

The non-contact sensor 42 detects an object existing around the loading machine 30. The non-contact sensor 42 is connected to the processing device 76 and outputs the detection result to the processing device 76. The non-contact sensor 42 outputs the obtained result to the processing device 76. The reading device 43 detects the identification information (the original information) of the mark provided in the drift DR or the cross cut CR.

The mark is disposed at a plurality of positions along the drift DR or the cross cut CR. The reading device 43 is connected to the processing device 76 and outputs a detection result to the processing device 76. The mark may be an identifier (a code) like a barcode and a two-dimensional code or may be an identifier (a tag) like an IC tag and an RFID.

In the embodiment, the information on the position (the absolute position) in which the mark is disposed in the drift DR or the cross cut CR is given information measured in advance. The information on the absolute position of the mark is stored in the storage device 77. The processing device 76 can obtain the absolute position of the loading machine 30 in the drift DR or the cross cut CR based on the storage information of the storage device 77 and the detection result of the mark (the identification information of the mark) detected by the reading device 43 provided in the loading machine 30.

The three-dimensional scanner 44 obtains and outputs the spatial physical shape data. The gyro sensor 45 detects the orientation (the orientation change amount) of the loading machine 30 and outputs a detection result to the processing device 76. The speed sensor 46 detects the traveling speed of the loading machine 30 and outputs a detection result to the processing device 76. The acceleration sensor 47 detects the acceleration of the loading machine 30 and outputs a detection result to the processing device 76. The driving control device 48 is, for example, a microcomputer. Based on an instruction from the processing device 76, the driving control device 48 controls the operation of the motor 33M driving the rotation roller 33 illustrated in FIG. 13, motors 48L and 48R of the traveling device 34, a motor 49 swinging the boom 32*a* of the support mechanism 32, a motor 50 swinging the arm 32*b*, a motor 51F driving the feeder 31, a motor 51R rotating the rotation body 36, and a motor 86 driving a hydraulic pump 85. The hydraulic pump 85 is a device which supplies hydraulic oil to the hydraulic cylinder 83 of the switching mechanism 80, a hydraulic cylinder 87 serving as an actuator changing the posture of the feeder 31, and the hydraulic cylinder 30FC of the fixing device 30F. The boom 32*a* and the arm 32*b* may be swung by the hydraulic cylinder. In this case, hydraulic oil is supplied from the hydraulic pump 85 to a boom cylinder swinging the boom 32*a* and an arm cylinder swinging the arm 32*b*. The motor 48L drives one crawler 34C illustrated in FIG. 14 and the motor 48R drives the other crawler 34C.

In the embodiment, the loading machine 30 travels by the motors 48L and 48R of the traveling device 34, but the invention is not limited thereto. For example, the loading machine 30 may travel by a hydraulic motor driven by the hydraulic oil ejected from the hydraulic pump 85. Further, the boom 32*a* and the arm 32*b* of the support mechanism 32, the rotation roller 33, the rotation body 36, and the feeder 31 may be driven by a hydraulic cylinder or a hydraulic motor driven by the hydraulic oil ejected from the hydraulic pump 85.

The three-dimensional scanner 44 includes a scan type electronic distance meter capable of outputting spatial physical shape data. The three-dimensional scanner 44 includes, for example, at least one of a laser scanner and a three-dimensional distance sensor and can obtain and output three-dimensional spatial data. The three-dimensional scanner 44 detects at least one of the transporting machine 10 and the wall surfaces of the drift DR and the cross cut CR. In the embodiment, the three-dimensional scanner 44 can obtain at least one of the shape data of the transporting machine 10, the wall surface shape data of the drift DR or the cross cut CR, and the load shape data of the vessel 11 of the transporting machine 10. Further, the three-dimensional scanner 44 can detect at least one of the relative position (the relative distance and the orientation) with respect to the transporting machine 10 and the relative position with respect to the wall surface of the drift DR or the cross cut CR. The three-dimensional scanner 44 outputs the detected information to the processing device 76.

In the embodiment, the information on the wall surfaces of the drift DR and the cross cut CR is obtained in advance and is stored in the storage device 77. That is, the information on the wall surface of the drift DR is given information measured in advance. The information on the wall surface of the drift DR includes information on the shapes of a plurality of parts of the wall surface and information on the absolute positions of the parts of the wall surface. The storage device 77 store a relation of the shapes of the plurality of parts of the wall surface and the absolute positions of the parts of the wall surface having the shape. The processing device 76 can obtain the absolute position and the orientation of the loading machine 30 in the drift DR based on the storage information of the storage device 77 and the detection result (the wall surface shape data) of the wall surface in the drift DR detected by the three-dimensional scanner 20 provided in the loading machine 30.

The processing device 76 controls the loading machine 30 traveling in the drift DR or the cross cut CR so that the loading machine 30 travels along the determined course (the target course) of the underground mine MI based on the current position (the absolute position) of the loading machine 30 derived by at least one of the reading device 43 and the three-dimensional scanner 44. At this time, the processing device 76 controls the loading machine 30 so that the loading machine is disposed at the designated draw point DP.

The processing device 76 is, for example, a microcomputer including a CPU. The processing device 76 controls the motors 48L and 48R of the traveling device 34 through the driving control device 48 based on the detection result of the front image capturing device 40C, the rear image capturing device 41C, the non-contact sensor 42, and the reading device 43. Then, the processing device 76 causes the loading machine 30 to travel along the target course at a predetermined traveling speed and a predetermined acceleration.

The storage device 77 includes at least one of a RAM, a ROM, a flash memory, and a hard disk drive and is connected to the processing device 76. The storage device 77 store a computer program and various kinds of information necessary when the processing device 76 causes the loading machine 30 to travel autonomously. The communication device 52 is connected to the processing device 76 and communicates with at least one of the communication device and the management device 3 mounted on the transporting machine 10 according to a data communication.

In the embodiment, the loading machine 30 is an unmanned vehicle and can travel autonomously. The communication device 52 can receive information (including an instruction signal) transmitted from at least one of the management device 3 and the transporting machine 10 through an antenna 53. Further, the communication device 52 can transmit the information detected by the front image capturing device 40C, the rear image capturing device 41C, the non-contact sensor 42, the reading device 43, the three-dimensional scanner 44, the gyro sensor 45, the speed sensor 46, and the acceleration sensor 47 to at least one of the management device 3 and the transporting machine 10 through the antenna 53. The loading machine 30 is not limited to the unmanned vehicle which can travel autonomously. For example, the management device 3 may obtain an image captured by the front image capturing device 40C and may display the image on the display device 8 illustrated in FIG. 6. Then, the operator may control the excavating operation, the loading operation, and the traveling operation of the loading machine 30 while seeing the displayed image through the remote operation. Further, the management device 3 may obtain an image captured by the rear image capturing device 41C and display the image on the display device 8 illustrated in FIG. 6. Then, the operator may control the excavating operation and the loading operation of the loading machine 30 and the operation of the vessel 11 of the transporting machine 10 while seeing the displayed image through the remote operation.

For example, the management device 3 which obtains the information detected by the speed sensor 46 and the acceleration sensor 47 stores the information as the operation information of the loading machine 30 in, for example, the storage device 3M. Further, when the management device 3 obtains the information captured by the front image capturing device 40C or the rear image capturing device 41C, the operator can operate the loading machine 30 while seeing the peripheral image of the loading machine 30 captured by the front image capturing device 40C or the rear image capturing device 410. Further, the transporting machine 10 which obtains the image on the state of the ore MR of the vessel 11 detected by the rear image capturing device 41C can control the position of the vessel 11 or the amount of the ore MR loaded on the vessel 11 based on the information. In the embodiment, the loading machine 30 is operated electrically, but an internal combustion engine may be used as a power source. Next, the storage battery treatment device EX provided in the space SP illustrated in FIG. 2 will be described.

Figure 18:
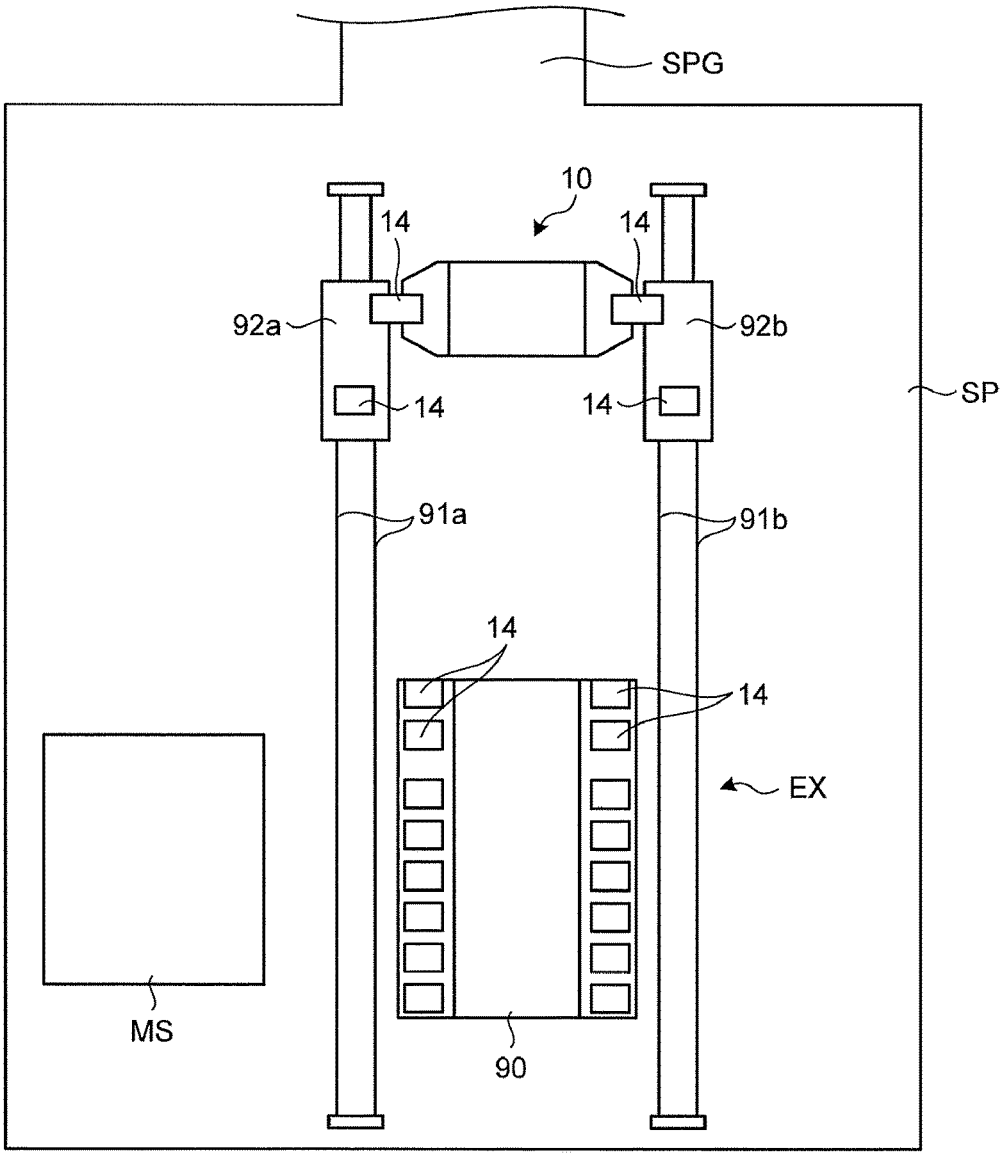
FIG. 18 is a diagram illustrating an example of a storage battery treatment device EX of a mine mining system according to the embodiment.

FIG. 18 is a diagram illustrating an example of the storage battery treatment device EX of the mine mining system 1 according to the embodiment. The storage battery treatment device EX is provided inside the space SP. In the embodiment, the space SP is provided with a maintenance space MS used to repair the transporting machine 10 and the loading machine 30. The storage battery treatment device EX includes a storage battery holder 90, a pair of guides 91*a* and 91*b* provided at both sides of the storage battery holder, and exchange support bases 92*a* and 92*b* respectively guided by the guides 91*a* and 91*b*. The storage battery holder 90 holds the exchange storage batteries 14. The storage battery holder 90 serves as a charger that charges the discharged storage battery 14. The guide 91*a* is provided at one side of the storage battery holder 90 and the guide 91*b* is provided at the other side of the storage battery holder 90. The guides 91*a* are two rails which extend from the storage battery holder 90 toward a gateway SPG of the space SP. The guide 91*b* is also similar to the guide 91*a*. The support base 92*a* is attached to the guide 91*a* and moves along the guide 91*a*. Then, the support base 92*b* is attached to the guide 91*b* and moves along the guide 91*b*.

The transporting machine 10 which enters the space SP in order to replace the storage battery 14 is stopped between the guide 91*a* and the guide 91*b*. At this time, the transporting machine 10 is stopped so that one storage battery 14 faces the guide 91*a* and the other storage battery 14 faces the guide 91*b*. The support base 92*a* and the support base 92*b* receive the charged storage battery 14 from the storage battery holder 90 and move toward the transporting machine 10. When the support base 92*a* and the support base 92*b* move to a position facing the transporting machine 10, the discharged storage battery 14 mounted on the transporting machine 10 is moved from the transporting machine 10 toward the upside thereof. Next, the support base 92*a* and the support base 92*b* respectively move to a position where the charged storage battery 14 faces the transporting machine 10. Subsequently, the support base 92*a* and the support base 92*b* load the charged storage battery 14 onto the transporting machine 10. The support base 92*a* and the support base 92*b* return to the position of the storage battery holder 90 so that the storage battery 14 collected from the transporting machine 10 is moved to the storage battery holder 90. The storage battery holder 90 charges the storage battery. In this way, the storage battery 14 of the transporting machine 10 is replaced.

The storage battery 14 of the transporting machine 10 does not need to be attachable or detachable. In this case, the storage battery treatment device EX may charge the storage battery 14 of the transporting machine 10.

In the embodiment, the transporting machine 10 travels by the storage battery 14. For this reason, the storage battery treatment device EX inside the space SP is mounted on the transporting machine 10 so as to exchange the discharged storage battery 14 with the charged storage battery 14. As described above, the loading machine 30 receives power from the power feeding cable 5 illustrated in FIG. 3 and the like so that the rotation roller 33 and the feeder 31 are operated. Since the loading machine 30 moves in the underground mine, for example, in order to move to a different draw point DP, the loading machine is separated from the power feeding cable 5 in this case. For this reason, the loading machine 30 includes a storage battery for driving the traveling motors 48L and 48R illustrated in FIG. 17. The storage battery is charged by the power supplied from the power feeding cable 5 when the loading machine 30 excavates and loads the ore MR at the draw point DP. The storage battery of the loading machine 30 is replaced in, for example, the maintenance space MS inside the space SP, for example, when the performance is degraded from the allowable value due to the use.

<Traveling Course of Transporting Machine 10>

Figure 19:
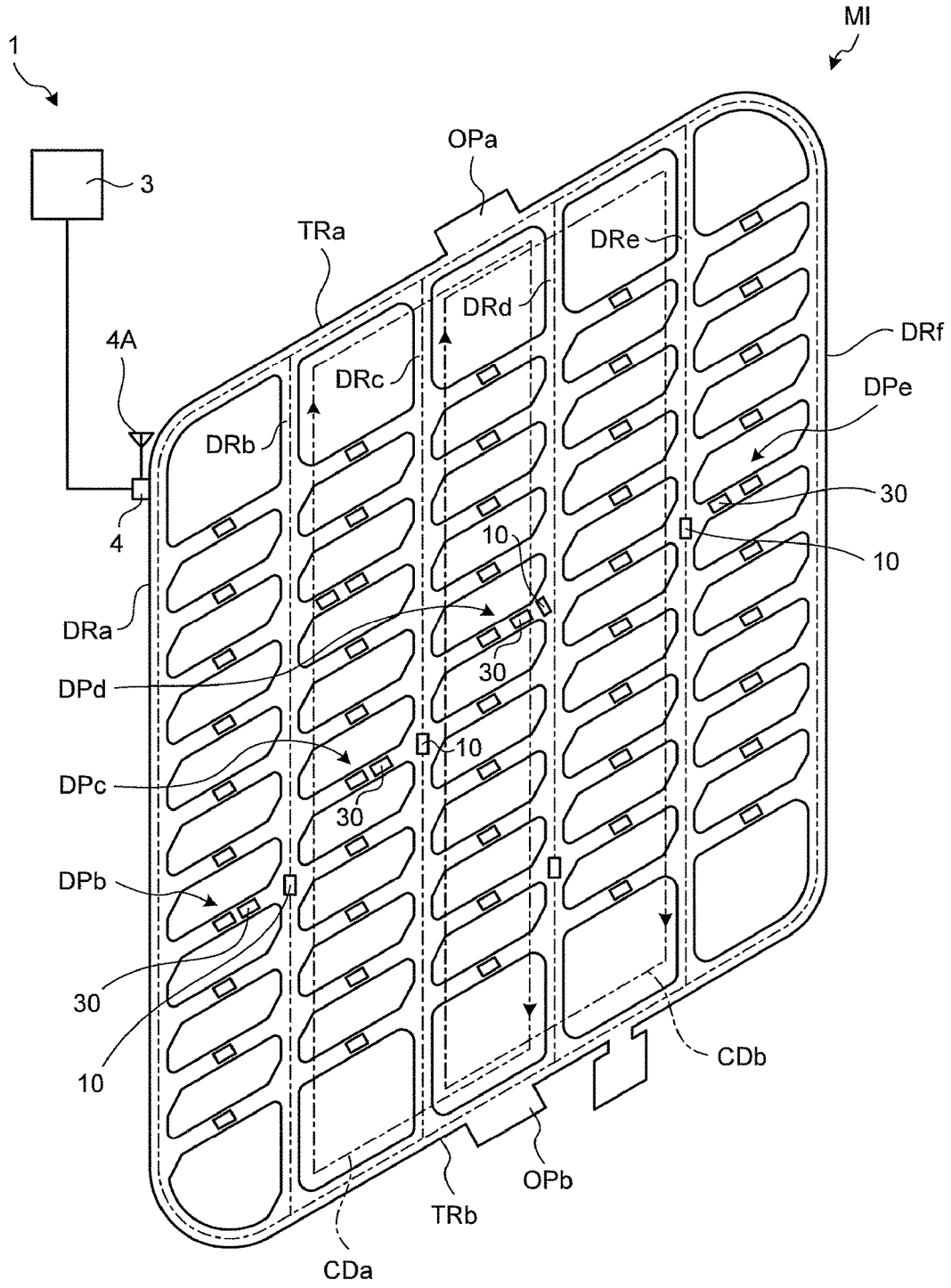
FIG. 19 is a diagram illustrating a direction in which the transporting machine travels in a drift of an underground mine in the mine mining system according to the embodiment.

FIG. 19 is a diagram illustrating a direction in which the transporting machine 10 travels in the drift DR of the underground mine MI in the mine mining system 1 according to the embodiment. In the next description, when the drifts DR, the outer tracks TR, the draw points DP, or the ore passes OP provided in the underground mine MI are distinguished, the signs a, b, and the like are given to the sign DR, the sign TR, the sign DP, or the sign OP. The signs a, b, and the like are not given when the drifts DR, the outer tracks TR, the draw points DP, and the ore passes OP are not distinguished from one another.

In the mine mining system 1 illustrated in FIG. 19, six drifts DRa, DRb, DRc, DRd, DRe, and DRf and two outer tracks TRa and TRb are formed in the underground mine. In the embodiment, a circuit CD is formed by the drift DR and the outer track TR. Specifically, one circuit CD is formed by the connection of the drifts DR and the outer tracks TR. For example, a circuit CDa is formed by two drifts DRb and DRd and two outer tracks TRa and TRb. Further, a circuit CDb is formed by two drifts DRc and DRe and two outer tracks TRa and TRb. Likewise, in the embodiment, one circuit CD is formed by two drifts DR and two outer tracks TR. In this case, one circuit CD is formed by two drifts DR and two outer tracks TR, but two drifts DR of one circuit CD have different traveling directions.

It is desirable to dispose one loading machine 30 in one drift DR to the maximum. Even when two or more loading machines 30 are disposed in the same drift, two or more loading machines are useless.

When the transporting machine 10 loads the ore MR mined at the draw point DP and discharges the ore to the ore pass OP, it is desirable to form the circuit CD in which the transporting machine 10 travels so that the circuit includes at least one of the ore pass OPa and the ore pass OPb. The circuit CD in which the transporting machine 10 travels toward the storage battery treatment device EX provided in the space SP so as to replace the storage battery 14 illustrated in FIGS. 7 and 8 without loading the ore MR thereon may not include the ore pass OPa and the ore pass OPb. The management device 3 can arbitrarily create the circuit CD every transporting machine 10. For example, the management device 3 may create the circuit CD in response to the state of the transporting machine 10. As an example, when the capacity of the storage battery 14 of the transporting machine 10 is lower than a predetermined threshold value and the ore MR is not loaded on the vessel 11 of the transporting machine 10, the management device 3 can create the shortest circuit CD from the current position to the space SP by the replacement of the storage battery 14 of the transporting machine 10 at the storage battery treatment device EX.

The transporting machine 10 traveling in the drift DR travels in the circuit CD in the same direction. In the embodiment, the transporting machine travels in the circuit CD in the clockwise direction. At this time, the transporting machine 10 loads the ore MR from the loading machine 30 at the draw point DP. Then, the transporting machine 10 discharges the loaded ore MR at the ore pass OPa or the ore pass OPb. For example, the transporting machine 10 traveling in the circuit CDa loads the ore MR from the loading machine 30 at a draw point DPb connected to the drift DRb. Subsequently, the transporting machine 10 travels in the drift DRb and the outer track TRa and discharges the ore MR to the ore pass OPa adjacent to the outer track TRa. The transporting machine 10 which discharges the ore MR therefrom travels in the drift DRd and loads the ore MR thereon from the loading machine 30 at the draw point DPd connected to the drift DRd. Subsequently, the transporting machine 10 travels in the drift DRd and the outer track TRb and discharges the ore MR to the ore pass OPb adjacent to the outer track TRb.

The transporting machine 10 traveling in the circuit CDb loads the ore MR thereon from the loading machine 30 at a draw point DPc connected to the drift DRc. Subsequently, the transporting machine 10 travels in the drift DRc and the outer track TRa and discharges the ore MR to the ore pass OPa adjacent to the outer track TRa. The transporting machine 10 which discharges the ore MR therefrom travels in the drift DRe and loads the ore MR from the loading machine 30 at a draw point DPe connected to the drift DRe. Subsequently, the transporting machine 10 travels in the drift DRe and the outer track TRb and discharges the ore MR to the ore pass OPb adjacent to the outer track TRb.

Likewise, when the transporting machine 10 travels in the circuit CD in one direction, it is possible to suppress the crossing of the transporting machine 10 to the minimum compared with the case where the transporting machine moves in a reciprocating manner between the draw point DP and the ore pass OP. Further, when the circuit CD includes both the ore pass OPa and the ore pass OPb, it is possible to perform the operation of loading and discharging the ore MR two times while the transporting machine 10 travels in the circuit CD by one round and hence to increase the conveying amount of the ore MR. As a result, the mine mining system 1 can improve the cycle time and the productivity of the mine. Further, since the transporting machine 10 travels in one direction in the circuit CD, it is possible to suppress the crossing of the transporting machine 10. For this reason, the number of positions necessary for the crossing can be decreased. Further, the position necessary for the crossing may not be provided if the crossing is not needed. As a result, since there is no need to thoughtlessly increase the width of the mine shaft, it is possible to suppress the effort, the time, and the cost necessary for the excavating operation in the mine shaft.

In the embodiment, the traveling direction of the transporting machine 10 or the like in each drift DR is determined as one direction (one-way traffic) in every drift DR. That is, the traveling operation in only one direction is allowed in each drift DR. When the transporting machine 10 or the like travels in the circuit CD in the clockwise direction, for example, the traveling direction of the drift DRb belonging to the circuit CDa is a direction directed from the ore pass OPb toward the ore pass OPa. In this case, the transporting machine 10 cannot travel in the drift DRb so as to be directed from the ore pass OPa toward the ore pass OPb.

When the transporting machine 10 or the like travels in the circuit CD in one direction, the management device 3 creates the circuit CD so that the transporting machine 10 does not cross another transporting machine or the loading machine 30 in each drift DR. For example, when the management device 3 creates a new circuit CD, the new circuit CD is included in the existing circuit CD. As a result, it is not possible to create the new circuit CD so that the transporting machine travels reversely in the drift DR in which the traveling direction is determined as one direction. When the new circuit CD is created by using the drift DR included in the existing circuit CD, the management device 3 causes the traveling direction of the new circuit CD to match the traveling direction of the drift DR included in the existing circuit CD. With such a configuration, it is possible to reduce or avoid the crossing of the transporting machine 10 in the circuit CD.

In the mine mining system 1, six drifts DR are connected to the outer track TRa provided with the ore pass OPa and six drifts DR are also connected to the outer track TRb provided with the ore pass OPb. In the extension direction of the outer track TRa, the same number of (in the embodiment, three) drifts DR are connected to the outer track TRa in any direction based on the ore pass OPa. Similarly, in the extension direction of the outer track TRb, the same number of (in the embodiment, three) drifts DR are connected to the outer track TRb in any direction based on the ore pass OPb. In the mine mining system 1 including the drift DR and the outer track TR, the circuit CD including both the ore pass OPa and the ore pass OPb has nine patterns as below.

(1) Pattern 1: drift DRa, outer track TRa, drift DRf, outer track TRb (2) Pattern 2: drift DRa, outer track TRa, drift DRe, outer track TRb (3) Pattern 3: drift DRa, outer track TRa, drift DRd, outer track TRb (4) Pattern 4: drift DRb, outer track TRa, drift DRf, outer track TRb (5) Pattern 5: drift DRb, outer track TRa, drift DRe, outer track TRb (6) Pattern 6: drift DRb, outer track TRa, drift DRd, outer track TRb (7) Pattern 7: drift DRc, outer track TRa, drift DRf, outer track TRb (8) Pattern 8: drift DRc, outer track TRa, drift DRe, outer track TRb (9) Pattern 9: drift DRc, outer track TRa, drift DRd, outer track TRb In the mine mining system 1, since the transporting machine 10 travels in the circuit CD in one direction (for example, the clockwise direction), it is possible to suppress the crossing of the transporting machine 10 to the minimum and to perform the operation of loading and discharging the ore MR two times while the transporting machine 10 travels in the circuit CD by one round. In the embodiment, the position and the number of the ore passes OP provided in each outer track TR are not limited. When the drifts DR are connected to the pair of outer tracks TR and each outer track TR is provided with one ore pass OP, it is desirable in that the circuit CD has many patterns if the same number of drifts DR are connected in the extension direction of the outer track TR with respect to the ore pass OP.

As described above, in the embodiment, the mine mining system 1 separates the functions of the loading machine 30 and the transporting machine 10 from each other. For this reason, since the loading machine 30 can be used only for the excavating operation and the conveying operation and the transporting machine 10 can be used only for the operation of transporting the ore MR, each capability can be exhibited to the maximum. As a result, the mine mining system 1 can improve the productivity of the mine M.

Since the loading machine 30 and the transporting machine 10 are movable, the mine management system 1 can easily handle a change in the condition of the excavating area. For example, when the clogging of the ore MR called arching occurs at the draw point DP or the large mass of the ore MR appears at the draw point DP so that the feeder 31 of the loading machine 30 cannot perform the conveying operation, the loading machine 30 moves to the different draw point DP so as to continuously mine the ore MR therein. For this reason, since the mine management system 1 can suppress a time in which the ore MR cannot be mined to the minimum, the productivity of the mine M can be improved. Further, a loading machine having a function of crushing rock is allocated to the draw point DP in which the arching or the large mass occurs, and the arching or the large mass is crushed by the loading machine.

Since the loading machine 30 includes the rotation roller 33 and the feeder 31, it is possible to continuously excavate the ore MR and to load the ore on the transporting machine 10. For this reason, since the loading machine 30 can promptly load the excavated ore MR on the transporting machine 10, it is possible to improve the productivity of the mine by shortening the time necessary for the loading operation.

Although there is a method of mining the ore MR by the loading machine provided at the draw point DP, but since this method limits the movement of the loading machine in that the loading machine is fixed to the draw point DP. For this reason, when the arching occurs at the draw point DP or the large mass of the ore MR appears at the draw point DP, a loading machine having a function of crushing the rock cannot easily move close to the draw point DP. Further, there is a possibility that the loading machine may be damaged by the blasting for crushing the large mass. Since the mine mining system 1 can cause the loading machine 30 to travel freely as described above, the loading machine can move to the draw point DP different from the draw point DP where the arching or the like occurs so as to continuously mine the ore MR therein. As a result, since the mine mining system 1 can suppress a time in which the ore MR cannot be mined to the minimum, the productivity of the mine M can be improved.

The above-described components include a component which can be easily supposed by the person skilled in the art, a component which has substantially the same configuration, and a component which is included in a so-called equivalent range. Further, the above-described components can be appropriately combined with one another. Furthermore, various omissions, substitutions, or modifications of the components can be made without departing from the spirit of the embodiment.

REFERENCE SIGNS LIST

1 MINE MINING SYSTEM (MINE OPERATION MANAGEMENT SYSTEM)
3 MANAGEMENT DEVICE
3C PROCESSING DEVICE
3M STORAGE DEVICE
5 POWER FEEDING CABLE
10 TRANSPORTING MACHINE
10B VEHICLE BODY
11 VESSEL
12A, 12B VEHICLE WHEEL
14 STORAGE BATTERY
24 DRIVING CONTROL DEVICE
30 LOADING MACHINE
30B VEHICLE BODY
31 FEEDER
32 SUPPORT MECHANISM
33 ROTATION ROLLER
34 TRAVELING DEVICE
35 PENETRATION MEMBER
36 ROTATION BODY
40, 41 INFORMATION COLLECTING DEVICE
48 DRIVING CONTROL DEVICE
70, 75 CONTROL DEVICE
71, 76 PROCESSING DEVICE
72, 77 STORAGE DEVICE
80 SWITCHING MECHANISM
90 STORAGE BATTERY HOLDER
CR CROSS CUT (SECOND MINE SHAFT)
CD, CDa, CDb CIRCUIT
DR, DRa, DRb, DRc, DRd, DRe, DRf DRIFT (FIRST MINE SHAFT)
DP, DPa, DPb, DPc, DPe DRAW POINT (MINING AREA)
OP, OPa, OPb ORE PASS (SOIL DISCHARGE AREA)
RM ROCK MASS
TR, TRa, TRb OUTER TRACK (THIRD MINE SHAFT)

The invention claimed is:

1. A mine mining system mining ore from an ore body in a mine including a plurality of mining areas provided inside the ore body, a plurality of first mine shafts provided inside the ore body, and a plurality of second mine shafts connecting the mining areas and the plurality of first mine shafts, a plurality of third mine shafts connected to the plurality of first mine shafts, and a plurality of circuits formed by the plurality of third mine shafts and the plurality of first mine shafts, each of the second mine shafts being interconnected across two or more of the plurality of first mine shafts and extending along a respective number of the mining areas, the mine mining system comprising:

a transporting machine configured to load the ore mined in one or more of the mining areas and transport the ore to a soil discharge area adjacent to at least one of the plurality of third mine shafts by autonomously traveling in a circuit of the plurality of circuits; and a loading machine configured to stay in one of the plurality of second mine shafts when the transporting machine travels in the circuit, excavate the ore in one of the mining areas, convey the excavated ore in a direction moving away from the one of the mining areas, and load the ore on the transporting machine staying in the circuit.

2. The mine mining system according to claim 1, wherein the transporting machine is allowed to travel in only one direction in each of the plurality of first mine shafts.

3. The mine mining system according to claim 1, wherein the transporting machine travels in the circuit in one direction.

4. The mine mining system according to claim-1, wherein the circuit includes two first mine shafts of the plurality of first mine shafts and two third mine shafts of the plurality of third mine shafts, and the transporting machine travels in the two first mine shafts in different traveling directions respectively.

5. The mine mining system according to claim 1, wherein the mine includes a plurality of the soil discharge areas.

6. The mine mining system according to claim 1, wherein the transporting machine includes a traveling motor and a storage battery supplying power to the motor.

7. The mine mining system according to claim 6, further comprising:

a storage battery treatment device for replacing or charging the storage battery, wherein the storage battery is mounted on the transporting machine, and the storage battery treatment device is provided in a space connected to at least one of the plurality of third mine shafts.

8. The mine mining system according to claim 1, wherein the loading machine performs at least one of an ore excavating operation and a traveling operation by at least one of power supplied from an outside of the loading machine and power supplied from a storage battery mounted on the loading machine.

9. The mine mining system according to claim 8, wherein the plurality of first mine shafts or the plurality of second mine shafts are provided with a power supply device supplying power to the loading machine.

10. A mine mining system mining ore from an ore body in a mine including a plurality of mining areas provided inside the ore body, a plurality of first mine shafts provided inside the ore body, and a plurality of second mine shafts connecting the mining areas and the plurality of first mine shafts, a plurality of third mine shafts connected to the plurality of first mine shafts, and a plurality of circuits formed by the plurality of third mine shafts and the plurality of first mine shafts, each of the second mine shafts being interconnected across two or more of the plurality of first mine shafts and extending along a respective number of the mining areas, the mine mining system comprising:

a transporting machine configured to load the ore mined in one or more of the mining areas and transports the ore to a soil discharge area adjacent to at least one of the plurality of third mine shafts by autonomously traveling in a circuit of the plurality of circuits; and a loading machine configured to stay in one of the plurality of second mine shafts with a space left inside the plurality of first mine shafts so that the transporting machine can travel therein when the transporting machine travels in the circuit, excavate the ore in one of the mining areas, convey the excavated ore in a direction moving away from the one of the mining areas, and load the ore on the transporting machine staying in the circuit, wherein the transporting machine travels in a circuit of the plurality of circuits in one direction, the circuit is formed by two first mine shafts of the plurality of first mine shafts and two third mine shafts of the plurality of third mine shafts, and the two third mine shafts are respectively connected to the two first mine shafts.

* * * * *